US011285685B2

(12) United States Patent
Nakamoto et al.

(10) Patent No.: US 11,285,685 B2
(45) Date of Patent: Mar. 29, 2022

(54) APPARATUS FOR FEEDING BAG

(71) Applicant: FURUKAWA MFG. CO., LTD., Tokyo (JP)

(72) Inventors: Shuichi Nakamoto, Mihara (JP); Junichi Yokoro, Mihara (JP); Yuki Ashitani, Mihara (JP); Akihiko Matsumoto, Mihara (JP); Masao Kiso, Mihara (JP)

(73) Assignee: FURUKAWA MFG. CO., LTD., Tokyo (JP)

( * ) Notice: Subject to any disclaimer, the term of this patent is extended or adjusted under 35 U.S.C. 154(b) by 0 days.

(21) Appl. No.: 17/086,539

(22) Filed: Nov. 2, 2020

(65) Prior Publication Data

US 2021/0221086 A1 Jul. 22, 2021

(30) Foreign Application Priority Data

Jan. 17, 2020 (JP) ..... JP2020-005614

(51) Int. Cl.

| | |
|---|---|
| ***B31B 70/10*** | (2017.01) |
| ***B31B 70/00*** | (2017.01) |
| ***B31B 70/02*** | (2017.01) |
| ***B31B 70/14*** | (2017.01) |
| *B31B 155/00* | (2017.01) |

(52) U.S. Cl.

CPC ..... *B31B 70/10* (2017.08); *B31B 70/006* (2017.08); *B31B 70/022* (2017.08); *B31B 70/142* (2017.08); *B31B 2155/003* (2017.08)

(58) Field of Classification Search

CPC ..... B31B 70/10; B31B 70/142; B31B 70/022; B31B 70/006; B31B 70/94; B31B 2155/003; B26F 1/38; B65B 43/465

See application file for complete search history.

(56) References Cited

U.S. PATENT DOCUMENTS

| | | | | |
|---|---|---|---|---|
| 3,862,610 A * | 1/1975 | Brocklehurst | D05B 25/00 | 112/470.05 |
| 4,510,731 A * | 4/1985 | Mathieu | B65B 59/001 | 53/66 |
| 4,769,106 A * | 9/1988 | Busching | B29C 65/18 | 100/222 |
| 4,944,135 A * | 7/1990 | Treiber | B65B 11/54 | 198/464.2 |
| 5,445,053 A * | 8/1995 | Kallner | B65G 57/005 | 83/153 |

(Continued)

FOREIGN PATENT DOCUMENTS

| | | |
|---|---|---|
| JP | H8-25523 A | 1/1996 |
| JP | 2003-285378 A | 10/2003 |

*Primary Examiner* — Thomas M Wittenschlaeger

(74) *Attorney, Agent, or Firm* — Kusner & Jaffe

(57) ABSTRACT

A film roll on which a tube film is wound is supported by a lower shelf of a frame. The tube film is fed from a reel mechanism. A table for guiding the fed tube film is provided in the upper part of the apparatus. The tube film held by a clip mechanism on the table is drawn to the front end of the table, and the drawn tube film is cut into a predetermined length while being pressed by a press cutter. The clip mechanism is provided with a clip including a pair of fingers for holding the tube film. The clip mechanism is provided on a slide mechanism for reciprocating the clip.

9 Claims, 22 Drawing Sheets

(56) References Cited

U.S. PATENT DOCUMENTS

| | | | | | |
|---|---|---|---|---|---|
| 5,473,861 | A * | 12/1995 | Fukunaga | B65B 11/54 | 53/228 |
| 5,935,371 | A * | 8/1999 | Distefano | B65H 19/1852 | 156/304.3 |
| 6,170,236 | B1 * | 1/2001 | Whitby | B65B 11/54 | 53/441 |
| 6,189,302 | B1 * | 2/2001 | Kudo | B65B 11/54 | 53/556 |
| 6,195,967 | B1 * | 3/2001 | Todd | B65B 1/02 | 53/562 |
| 6,272,815 | B1 * | 8/2001 | Todd | B29C 65/18 | 53/51 |
| 8,555,946 | B2 * | 10/2013 | Luo | H01M 4/04 | 156/515 |
| 9,714,105 | B2 * | 7/2017 | Kariyada | B65H 3/0883 | |
| 2002/0166858 | A1 * | 11/2002 | Ogishima | B65D 77/2012 | 220/359.4 |
| 2005/0224373 | A1 * | 10/2005 | Bailey | B65D 31/12 | 206/219 |
| 2011/0214401 | A1 * | 9/2011 | Luo | B29C 65/743 | 53/559 |

* cited by examiner

APPARATUS FOR FEEDING BAG

FIELD OF THE INVENTION

The present invention relates to an apparatus for feeding bags, in which a tube film held by a clip mechanism is fed from a film roll and is cut into bags and then the cut bags are fed to a packing apparatus.

BACKGROUND OF THE INVENTION

An apparatus for feeding packing bags in JP 2003-285378A includes a packing-bag production unit in which a rotary drive for rotating a raw material roll (film roll), a raw material feeder, and a sealing cutter are sequentially disposed. In the apparatus for feeding packing bags, the raw material roll is placed onto the rotary drive in advance and a raw material fed from the raw material roll is passed between the rolls of the raw material feeder via a free roll and is delivered to the position of the sealing cutter. Between the rotary drive and the free roll, a tension roll is placed on the top surface of the raw material.

JP H8-25523A discloses a film feeding controller for a bag making machine that feeds a cylindrical film (tube film) and forms the film into bags. The film feeding controller for the bag making machine includes an arithmetic unit and a control unit. The arithmetic unit calculates a position for determining the time of monitoring a mark on the film. If the mark is detected, the arithmetic unit calculates a deceleration start position where the feed rate of the film is changed and a stop position. If the mark is not detected, the arithmetic unit calculates the deceleration start position and the stop position based on input data. The control unit compares a predetermined pulse number converted from the value of the arithmetic unit and an actual pulse number calculated by a counter and controls the driving of a motor.

In the technique of JP H8-25523A, data including a bag length and a length from a cutting position to the mark on the film is inputted by an input device, thereby optimally controlling the feeding of the film. Even if no mark is detected, the feeding of the film is controlled based on initial input data. If any consecutive marks are not detected several times, the operation of a motor drive is stopped. Thus, bags are smoothly formed.

SUMMARY OF THE INVENTION

JP 2003-285378A does not disclose a method of controlling the feeding of the film of the raw material roll by the rotary drive. In JP H8-25523A, the feeding of the cylindrical film by the feed roller is optimally controlled. In known techniques, a cylindrical film meanders while being fed, which requires a meandering correction function. However, JP H8-25523A does not disclose such a meandering correction function.

An object of the present invention is to provide an apparatus for feeding bags so as to hardly cause meandering of a tube film drawn from a film roll.

An apparatus for feeding bags according to the present invention includes:

- a reel mechanism supporting a film roll on which a tube film is wound, the reel mechanism feeding the tube film forward;
- a table for guiding the tube film fed from the reel mechanism;

- a clip mechanism including a clip for holding the tube film on the table, the clip mechanism drawing the tube film held by the clip to the front end of the table;
- a press cutter for cutting the tube film into a predetermined length while pressing the tube film drawn by the clip mechanism; and
- a drive mechanism for longitudinally reciprocating the clip mechanism.

A method for controlling an apparatus for feeding bags according to the present invention, includes the steps of:

- feeding a tube film from a film roll;
- cutting the tube film into a predetermined length after drawing the tube film to the front end of a table for guiding the fed tube film, the tube film on the table being held by a clip mechanism, and ejecting a bag formed by the cutting to a subsequent step;
- detecting the front edge of the tube film left when the tube film cut and left on the table is held again by the clip mechanism and is drawn to the front end of the table in the subsequent step; and
- releasing, when the front edge of the tube film is detected outside a predetermined position, the tube film held by the clip mechanism, moving the clip mechanism rearward according to a difference from the predetermined position, holding the tube film again by the clip mechanism, and drawing the tube film to the front end of the table.

The apparatus for feeding bags according to the present invention draws the held tube film, thereby hardly causing meandering of the tube film and substantially eliminating the need for correcting meandering. Furthermore, a method for controlling an apparatus for feeding bags according to the present invention reduces mistakes in the delivery of bags to a packaging machine.

DETAILED DESCRIPTION OF THE INVENTION

Embodiment 1

(The Basic Structure of a Mechanism for Feeding Bags)

Figure 1:
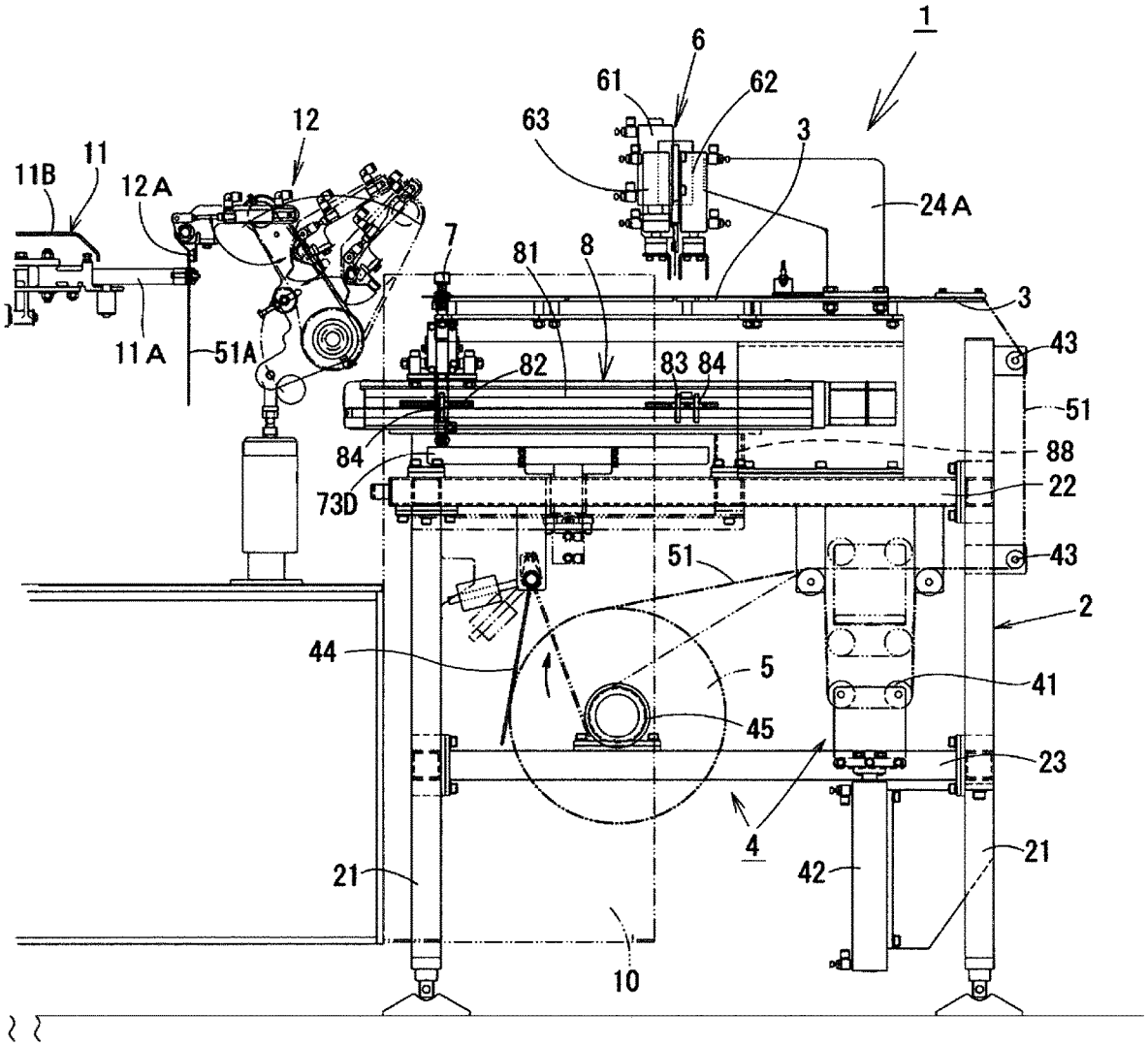
FIG. 1 is a front view illustrating a usage state of an apparatus for feeding bags according to Embodiment 1 of the present invention.

FIG. 1 is a front view illustrating a usage state of an apparatus for feeding bags according to the present invention. Bags are fed to for example an illustrated rotary packaging machine 11 and are used for packaging articles. The rotary packaging machine 11 includes pairs of clamp arms 11A disposed on the outer edge of a rotating rotor 11B. On the distal end of the clamp arm 11A, a clamp for holding one side of a bag 51A cut from a tube film 51 is provided. A chuck 12A of a bag delivery device 12 delivers the bag 51A on an apparatus 1 for feeding bags, to the clamp arm 11A of the rotary packaging machine 11. The rotary packaging machine 11 performs a packaging operation in each section by the rotation of the rotor 11B. The rotary packaging machine may be replaced with a linear packaging machine or an oval packaging machine. Reference numeral 10 denotes a control box.

The apparatus 1 for feeding bags according to the present invention includes a reel mechanism 4 for feeding the tube film 51 from a film roll 5 on which the tube film 51 is wound, a table 3 for guiding the tube film 51 fed from the reel mechanism 4, a clip mechanism 7 for drawing the tube film 51 to the front end of the table 3 while holding the tube film 51 on the table 3, and a press cutter 6 for pressing and cutting the tube film 51 into a predetermined length after the tube film 51 is drawn by the clip mechanism 7. The apparatus 1 for feeding bags includes a frame 2 for supporting the mechanism of the apparatus. The mechanism is disposed on an upper shelf 22 and a lower shelf 23 that are extended between legs 21. The reel mechanism 4 is disposed on the lower shelf 23. The table 3, the clip mechanism 7, and the press cutter 6 are disposed on the upper shelf 22. The configurations will be sequentially described in detail.

(Reel Mechanism)

As illustrated in FIG. 1, a shaft 45 supporting the film roll 5 is mounted on the lower shelf 23. The film roll 5 is a roll of the tube film 51. A new film roll 5 can be set on the shaft 45. Dancer rolls 41 are provided next to the film roll 5. An air cylinder 42 is vertically connected to the lower ends of the dancer rolls 41. The expansion and contraction of the piston rod of the air cylinder 42 can vertically move the dancer rolls 41. The dancer rolls 41 are vertically moved to feed the tube film 51 from the film roll 5.

Reference numeral 44 denotes a brake mechanism including a pressing plate for pressing the surface of the film roll 5. The brake mechanism 44 is provided to prevent the tube film 51 being fed from the dancer rolls 41 from excessively slipping and causing slack upstream of the dancer rolls 41. The brake mechanism 44 is not limited to the illustrated structure. Moreover, guide rollers 43 are attached to one side of the leg 21. The tube film 51 is fed from the film roll 5 by the dancer rolls 41 and is guided to the table 3 by the guide rollers 43.

(Tube Film)

Figure 3:
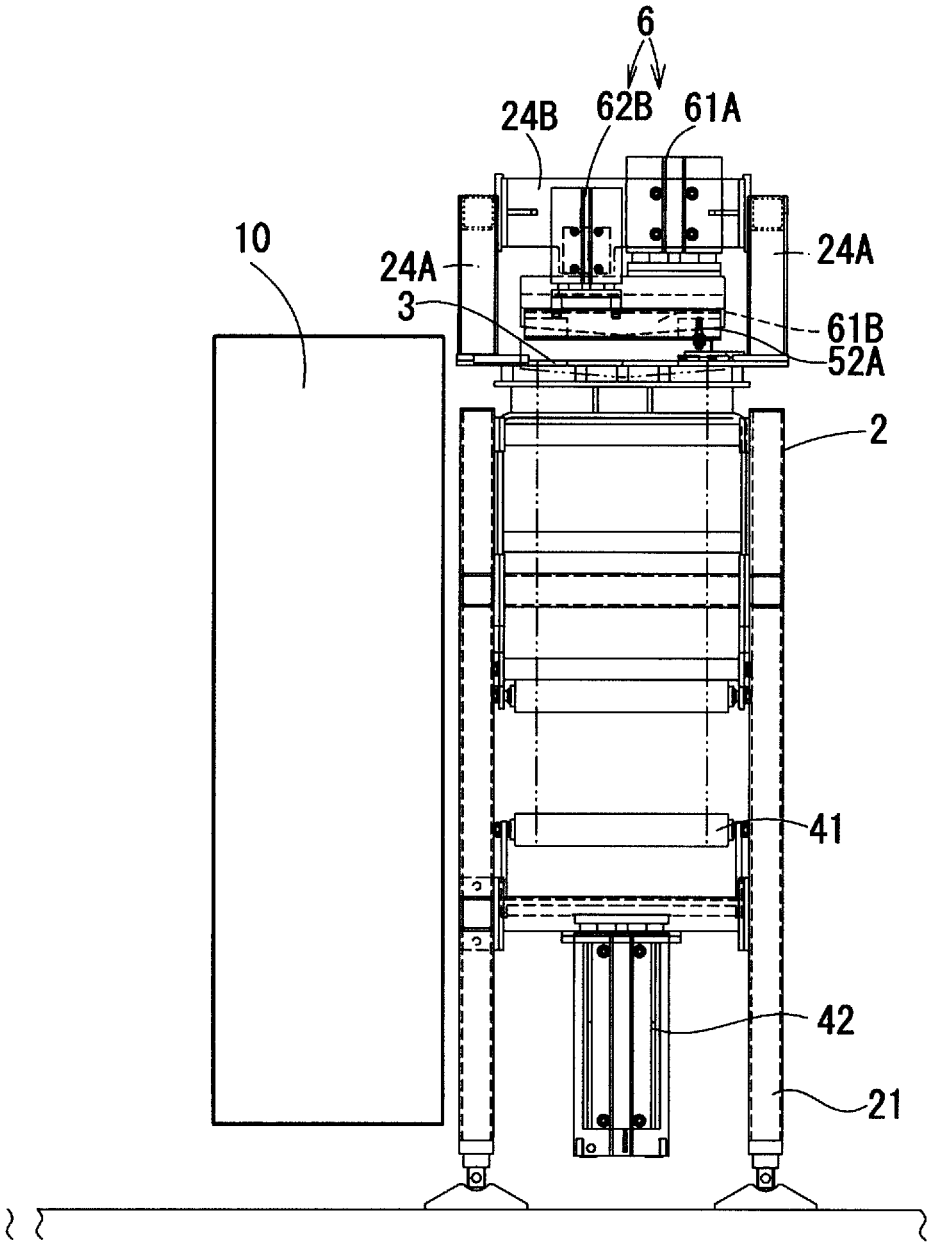
FIG. 3 is a right side view of the apparatus.
Figure 6A:
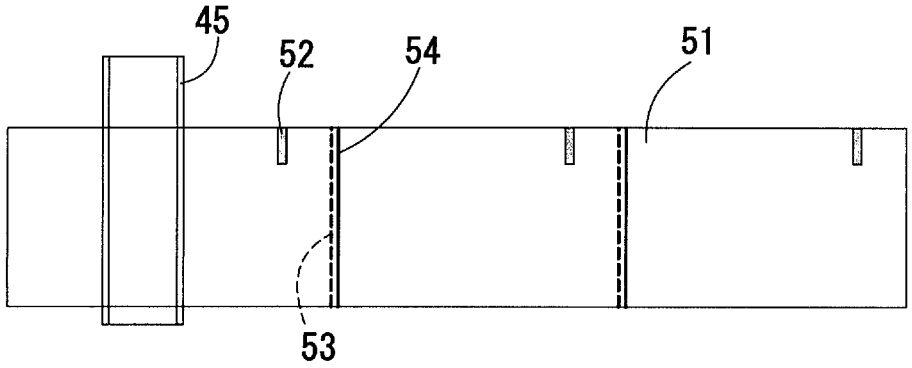
FIG. 6A is a front view of a film roll.
Figure 6B:
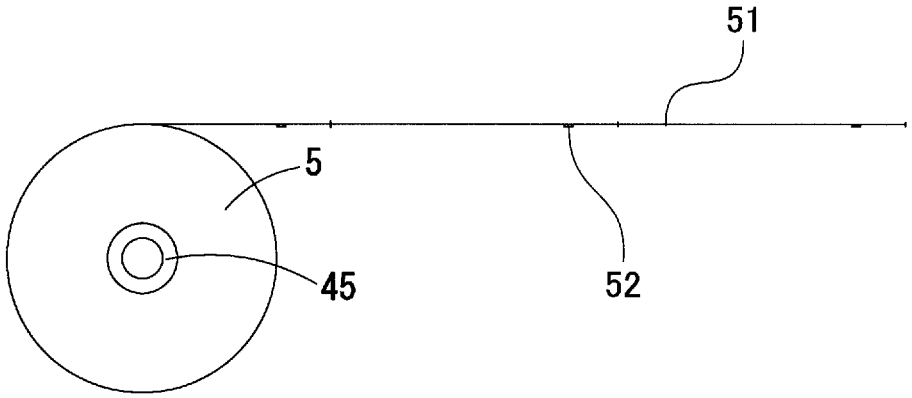
FIG. 6B is a plan view of a tube film.

Referring to FIGS. 6A and 6B, the tube film 51 will be specifically described below. The tube film 51 may be any kind of film, for example, a plastic film formed into a bag by inflation or a sheet film formed into a tube. Seals 54 extended in the width direction of the tube film 51 are formed at predetermined intervals in the longitudinal direction of the tube film 51. Perforations 53 parallel to the seal 54 are disposed behind the seal 54 (when the tube film 51 is fed forward, the perforations 53 are disposed downstream of the seal 54). The perforations 53 are pressed and cut by a cutting tool 61B of the press cutter 6 illustrated in FIG. 3. Thus, the tube film 51 is divided into the bags 51A. Without the perforations 53, the tube film 51 may be cut with a sharp cutting tool. However, by cutting at the perforations 53 with the cutting tool 61B that is not sharpened, the occurrence of cutting at wrong points is advantageously reduced.

Figure 2:
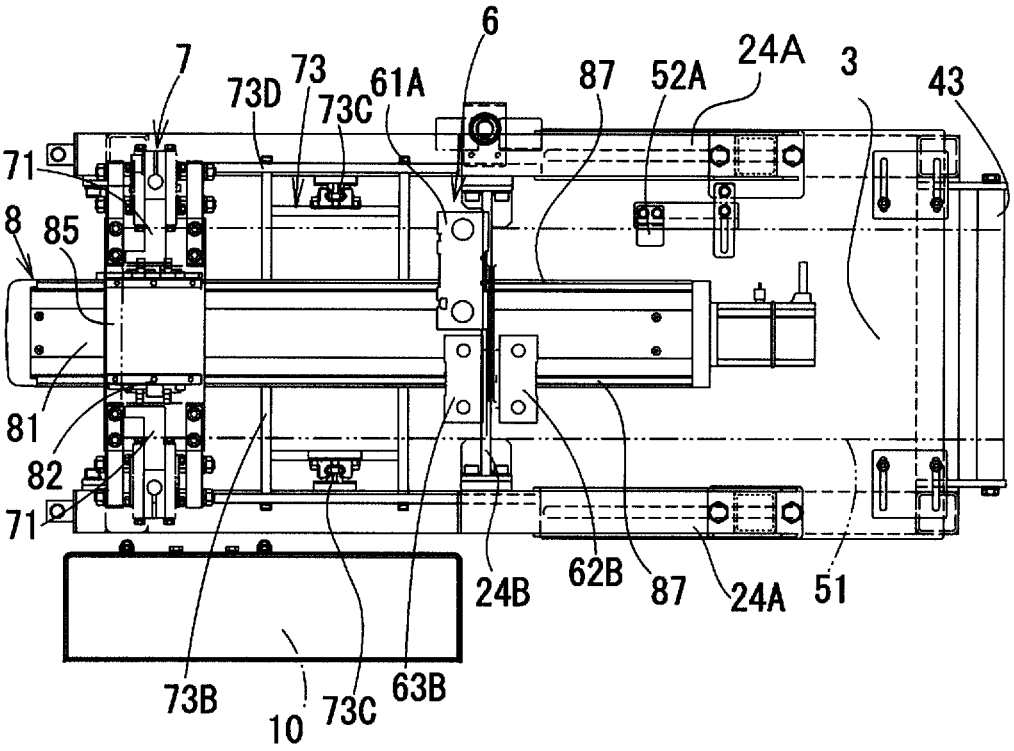
FIG. 2 is a plan view of the apparatus.

As illustrated in FIGS. 6A and 6B, a mark 52 is printed behind the perforations 53 on one side of the tube film 51 in the width direction. The mark 52 is similar to that described in JP H8-25523A and is used when the feeding of the tube film 51 is controlled. The mark 52 is detected by a mark detecting sensor 52A provided on one side of the table 3 as illustrated in FIG. 2. Based on the result of detection, the feeding pitch of the tube film 51 is correctly determined by a controller, which is not illustrated.

(Table)

Figure 7:
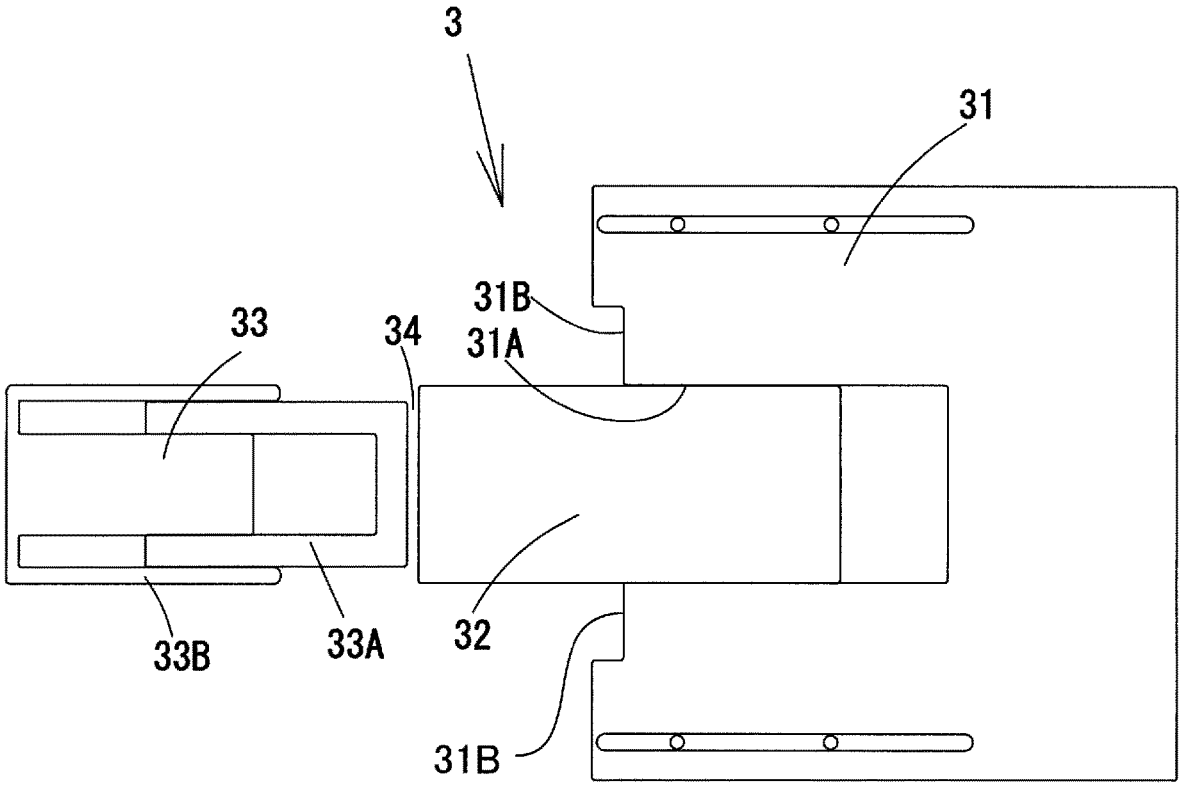
FIG. 7 is a plan view illustrating a table of the apparatus.

As illustrated in FIG. 7, the table 3 mainly includes three parts. Specifically, the table 3 includes a main body 31, an intermediate table 32, and a front-end table 33 from the rear. The main body 31 and the intermediate table 32 slide relative to each other and the intermediate table 32 and the front-end table 33 slide relative to each other, thereby increasing or reducing the length of the table 3. Between the intermediate table 32 and the front-end table 33, a clearance 34 is provided. The cutting tool 61B (see FIG. 11A) of a cutting mechanism 61 illustrated in FIG. 1 is inserted into the clearance 34. The parts of the table 3 longitudinally slide to change the length of the table 3, which is aimed at adjusting the length to the dimensions of the bag 51A.

The substrate of the main body 31 of the table 3 has a rectangularly cut portion at the center of the front side. The main body 31 is entirely square-cornered and is shaped like a reversed letter C in plan view. Notches 31B are formed on both sides of an opening 31A of the substrate that is square-cornered and is shaped like a reversed letter C. The notches 31B allow a bag-supporting guide 9 (see FIG. 5 and the like), which will be described later, to retract when moving backward. The width of the main body 31 is substantially equal to that of a bag feeding apparatus 1. The rectangular intermediate table 32 is slidably fit into the rectangular cut portion of the main body 31.

The front-end table 33 is disposed in front of the intermediate table 32 with the clearance 34 interposed between the front-end table 33 and the intermediate table 32. The dimensions of the clearance 34 are set so as to insert the cutting tool 61B of the press cutter 6 into the clearance 34.

The clearance 34 can be relocated by changing the positions of the intermediate table 32 and the front-end table 33 along the longitudinal direction. The front-end table 33 includes two members: a first front-end small table 33A and a second front-end small table 33B. The first front-end small table 33A is a thin member shaped like a reversed letter C. The thick central portion of the second front-end small table 33B shaped like a letter E is fit into the opening of the first front-end small table 33A so that the table 33B can slide back and forth. The second front-end small table 33B can be slid to change the length of the front-end table 33 according to the dimensions of the bag 51A.

The width of the intermediate table 32 and the width of the front-end table 33 are smaller than that of the tube film 51. The intermediate table 32 and the front-end table 33 have small widths so as to allow a clip 71 (see FIG. 10) of the clip mechanism 7 illustrated in FIG. 1 to hold both side edges of the tube film 51 extending out of the tables 32 and 33. As illustrated in FIGS. 1 and 2, a mounting leg 24A shaped like a reversed letter L is provided on each side of the main body 31. As illustrated in FIG. 2, a mounting plate 24B is erected between the mounting legs 24A on both sides and a first press cylinder 62B, a second press cylinder 63B, and an air cylinder 61A for cutting are mounted on the mounting plate 24B.

(Clip Mechanism and Slide Mechanism)

Figure 5:
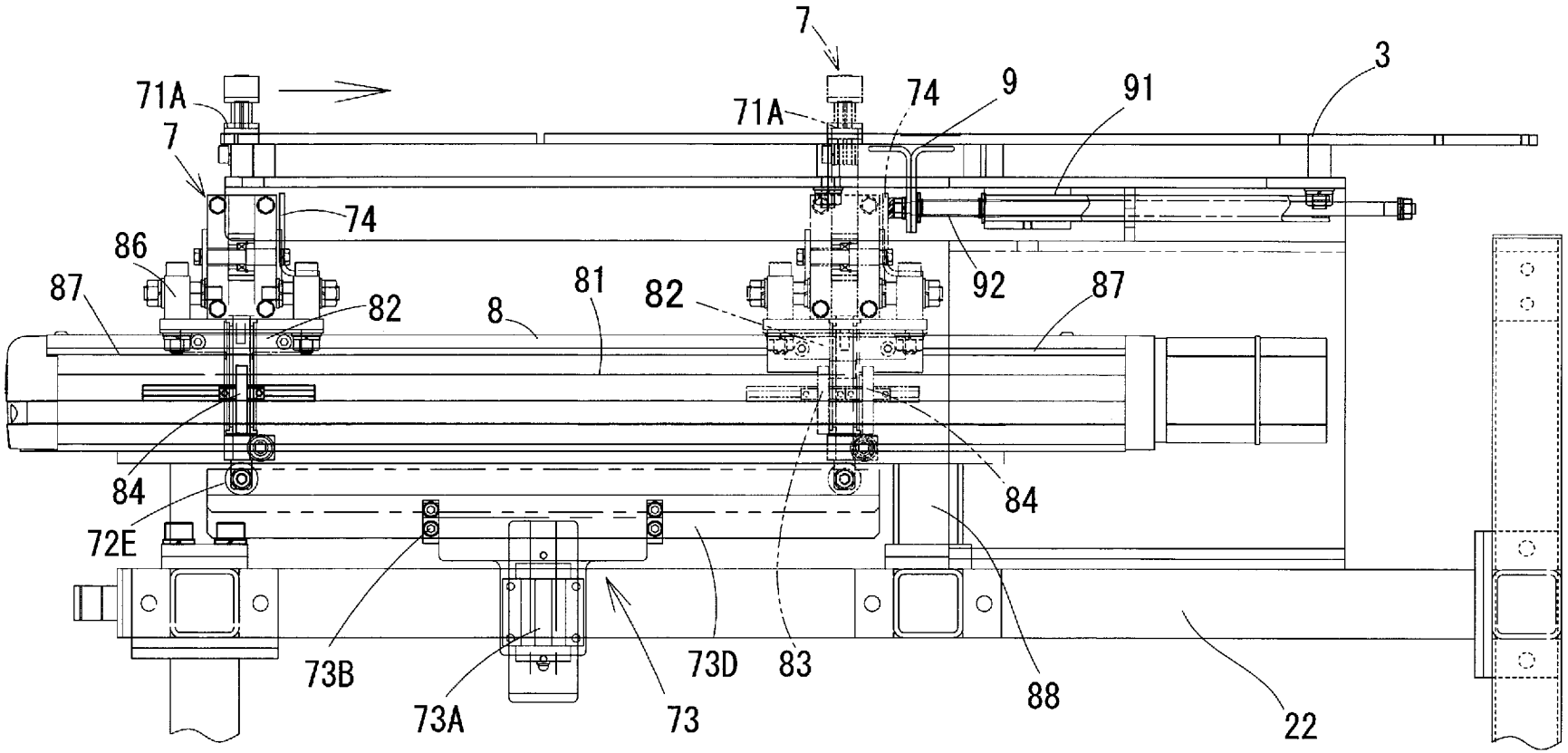
FIG. 5 is a partial plan view of the apparatus.

As illustrated in FIG. 1, a slide mechanism 8 on which the clip mechanism 7 is mounted includes a long electric actuator 81. As illustrated in FIG. 5, the electric actuator 81 is fixed to a central portion of the upper shelf 22 in the longitudinal direction with a pedestal 88 interposed between the electric actuator 81 and the upper shelf 22. As specifically illustrated in FIG. 2, the electric actuator 81 has a pair of slits 87 formed thereon in the longitudinal direction. As illustrated in FIG. 5, the electric actuator 81 includes sliders 82 that move along the slits 87. The clip mechanism 7 is attached to the slider 82. On the front end and the rear end of the electric actuator 81, limit sensors 84 are provided. Inside the limit sensor 84 on the rear end, that is, at a position closer to the limit sensor 84 on the front end than the limit sensor 84 on the rear end, an origin sensor 83 is provided.

Figure 4:
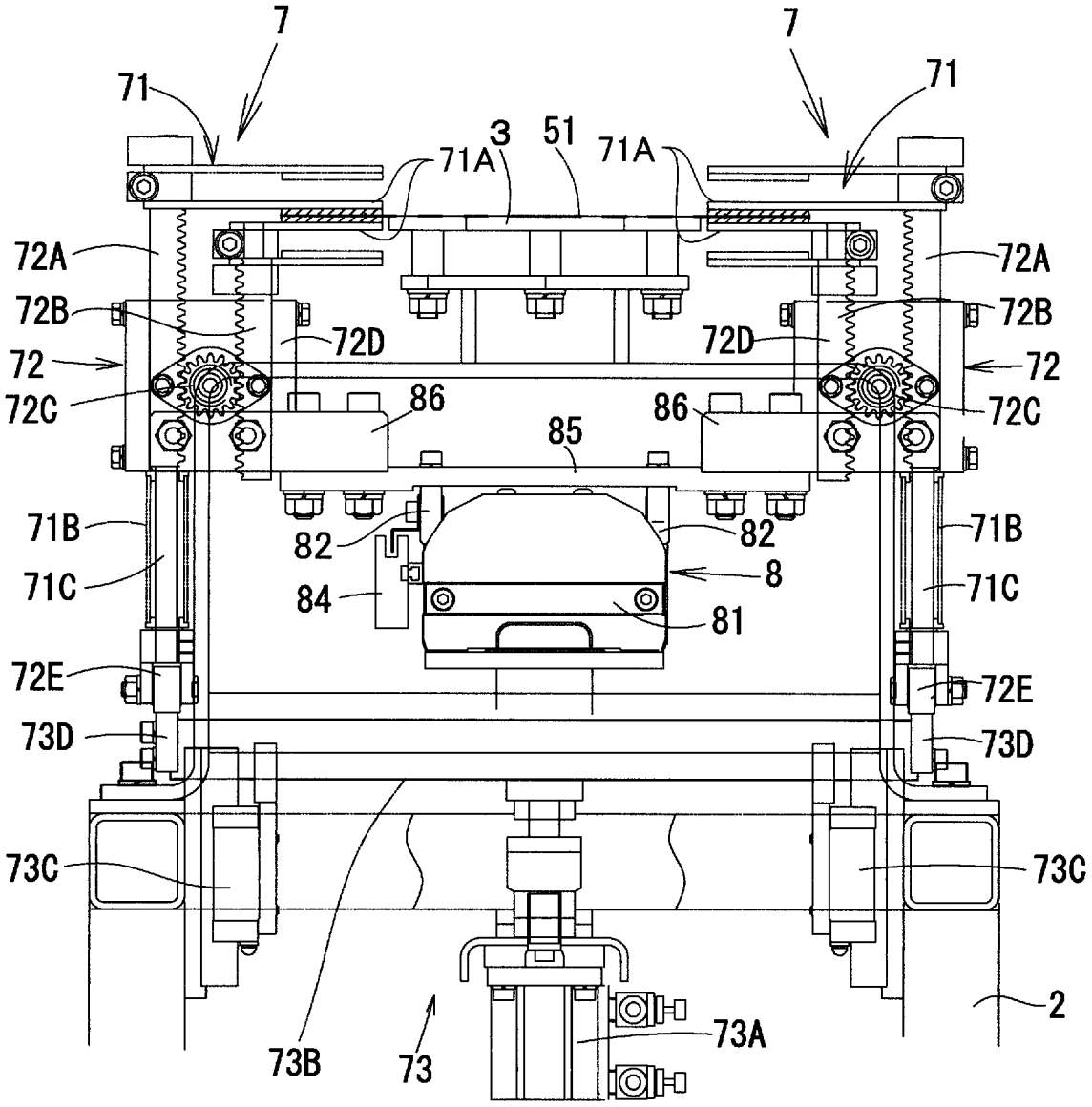
FIG. 4 is a partial side view of the apparatus.

As illustrated in FIG. 4, a mounting plate 85 for mounting the pair of clip mechanisms 7 is mounted over the pair of sliders 82 of the electric actuator 81. A fixed part 86 is attached to each end of the mounting plate 85. On the fixed part 86, a gear box 72D including racks 72A and 72B and a pinion 72C is fixed. The clip mechanism 7 includes the clip 71 and an open/close mechanism 72 for opening and closing a pair of fingers 71A in the clip 71. Reference numeral 73 denotes a hoisting and lowering mechanism for operating the open/close mechanism 72. As illustrated in FIG. 4, the clip 71 (fingers 71A) and the open/close mechanism 72 are disposed on each side of the table 3. With this configuration, the tube film 51 on the table 3 is held from both sides in the width direction and is drawn forward.

Figure 8:
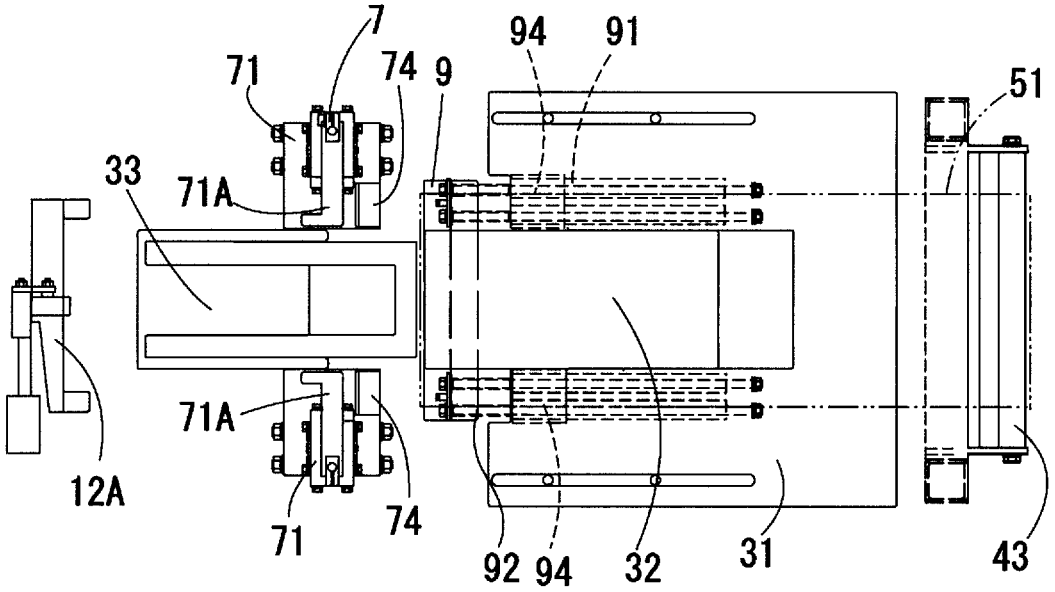
FIG. 8 is a partial plan view illustrating a usage state of the apparatus.
Figure 9:
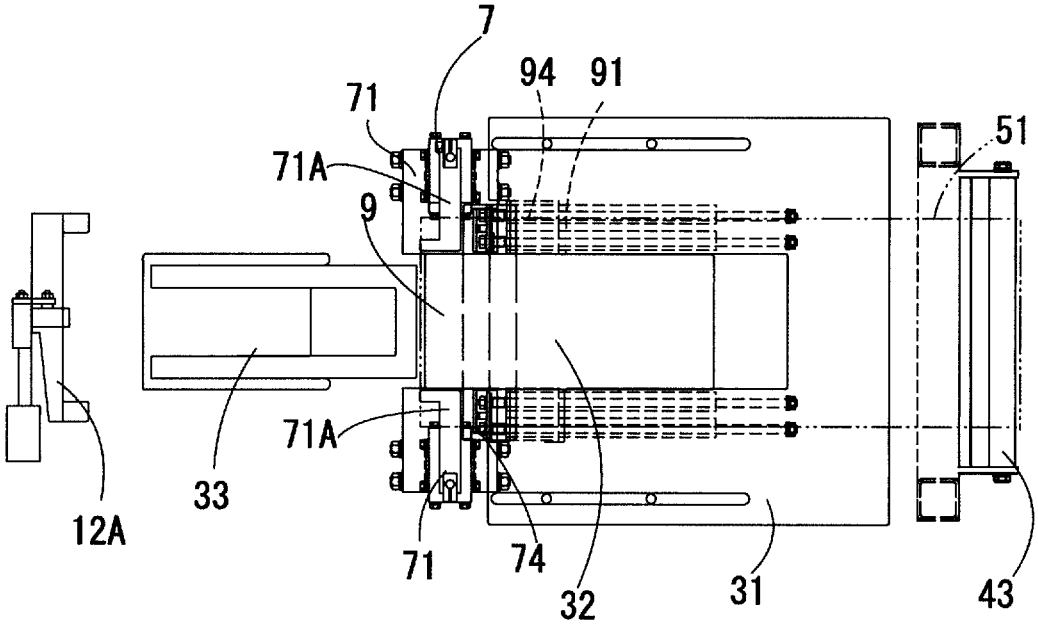
FIG. 9 is a partial plan view illustrating another usage state of the apparatus.
Figure 10:
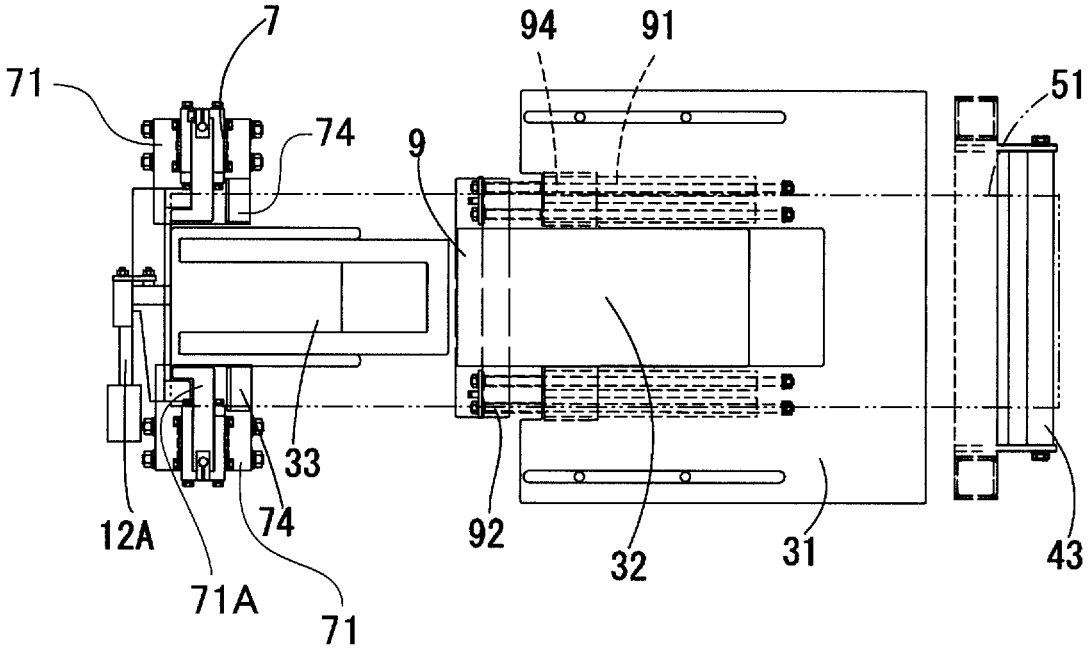
FIG. 10 is a partial plan view illustrating still another usage state of the apparatus.

As has been discussed, the clip 71 includes the pair of fingers 71A. The pair of fingers 71A vertically holds one side of the tube film 51 in the width direction. As illustrated in FIGS. 8 to 10, the finger 71A is an L-shaped plate in plan view. On the inner surfaces, that is, the facing surfaces of the pair of fingers 71A, non-slip members are attached. The L-shaped fingers 71A have projecting pieces projecting forward so as to horizontally support the front end of the tube film 51, so that the fingers 71A do not fail to hold the tube film 51.

As illustrated in FIG. 4, the open/close mechanism 72 is configured such that the first rack 72A and the second rack 72B are vertically attached to the respective ends of the pair of fingers 71A and the pinion 72C meshes with the racks 72A and 72B. From the first rack 72A disposed outside the apparatus along the width direction, a rod 71C on which a spring 71B is fit is extended downward. On the lower end of the rod 71C, a wheel 72E is supported. The rotating wheel 72E reciprocates on an elevating rail 73D, which extends in the horizontal direction, along the longitudinal direction of the apparatus. The elevating rail 73D is lifted and lowered, allowing the pinion 72C to vertically move the pair of first and second racks 72A and 72B in opposite directions via the wheel 72E and the rod 71C. This opens and closes the fingers 71A.

The hoisting and lowering mechanism 73 for hoisting and lowering the pair of elevating rails 73D is disposed below the electric actuator 81. The hoisting and lowering mechanism 73 includes a rail elevating cylinder 73A. An elevating frame 73B illustrated in FIGS. 4 and 2 is horizontally mounted on the extendable end of the piston rod of the rail elevating cylinder 73A. The elevating frame 73B is smoothly lifted and lowered by the actions of sliders 73C attached to the frame 2. The elevating rail 73D is mounted on each side of the elevating frame 73B. As has been discussed, the rotating wheel 72E reciprocates on the elevating rail 73D.

(Press Cutting Mechanism)

Figure 11A:
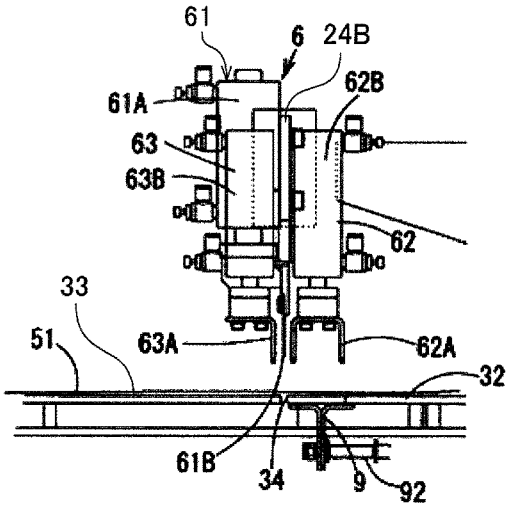
FIG. 11A illustrates a usage state of a press cutting mechanism of the apparatus.
Figure 11B:
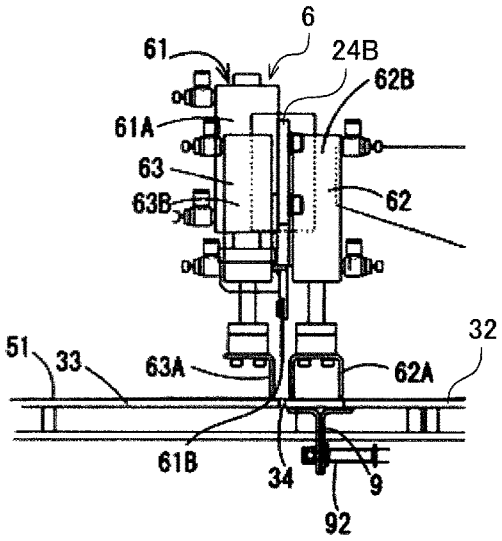
FIG. 11B illustrates another usage state of the press cutting mechanism.
Figure 11C:
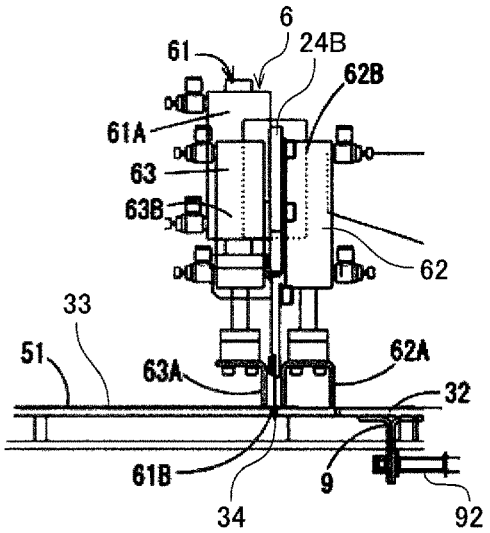
FIG. 11C illustrates still another usage state of the press cutting mechanism.

As illustrated in FIGS. 11A to 11C, the press cutter 6 is disposed above a portion between the intermediate table 32 and the front-end table 33. The press cutter 6 includes the cutting mechanism 61, a first pressing mechanism 62, and a second pressing mechanism 63. The cutting mechanism 61 includes the cutting tool 61B attached to the air cylinder 61A for cutting. The cutting mechanism 61 is lowered into the clearance 34 between the intermediate table 32 and the front-end table 33, thereby cutting the perforations 53 (see FIG. 6A) on the tube film 51. The cutting tool 61B is not limited to the sharpened thin plate as long as the perforations 53 are pushed and cut. The cutting tool 61B is disposed between the first pressing mechanism 62 and the second pressing mechanism 63.

In the first pressing mechanism 62, the first press cylinder 62B is attached to the rear surface of the mounting plate 24B and a first pressing piece 62A is attached to the piston rod of the first press cylinder 62B. The first pressing piece 62A is shaped like a letter C and is disposed above the front end of the intermediate table 32. In the second pressing mechanism 63, the second press cylinder 63B is attached to the front surface of the mounting plate 24B and a second pressing piece 63A is attached to the piston rod of the second press cylinder 63B. The second pressing piece 63A is shaped like a letter L and is disposed above the rear end of the front-end table 33.

The first pressing piece 62A of the first pressing mechanism 62 presses the tube film 51 on the intermediate table 32, the second pressing piece 63A of the second pressing mechanism 63 presses the tube film 51 on the front-end table 33, and the cutting tool 61B cuts the tube film 51, which is pressed by the first pressing mechanism 62 and the second pressing mechanism 63, at an intermediate position between the mechanisms 62 and 63.

(Bag-Supporting Guide)

When the tube film 51 on the intermediate table 32 is cut with the cutting tool 61B, the bag-supporting guide 9 in FIGS. 11A to 11C supports the tube film 51 so as to prevent both sides of the front end of the tube film 51 from bending downward. Specifically, as has been discussed, the width of the intermediate table 32 is smaller than that of the tube film 51. Thus, when the tube film 51 is cut with the cutting tool 61B of the press cutter 6, both sides of the front end of the cut tube film 51 may bend downward at a portion not supported by the intermediate table 32. If the front end of the tube film 51 bends downward, the fingers 71A of the clip mechanism 7 may fail to hold the tube film 51. As illustrated in FIG. 8, the bag-supporting guide 9 has a larger width than the intermediate table 32 and thus can horizontally support both sides of the cut front end of the tube film 51.

Figure 12:
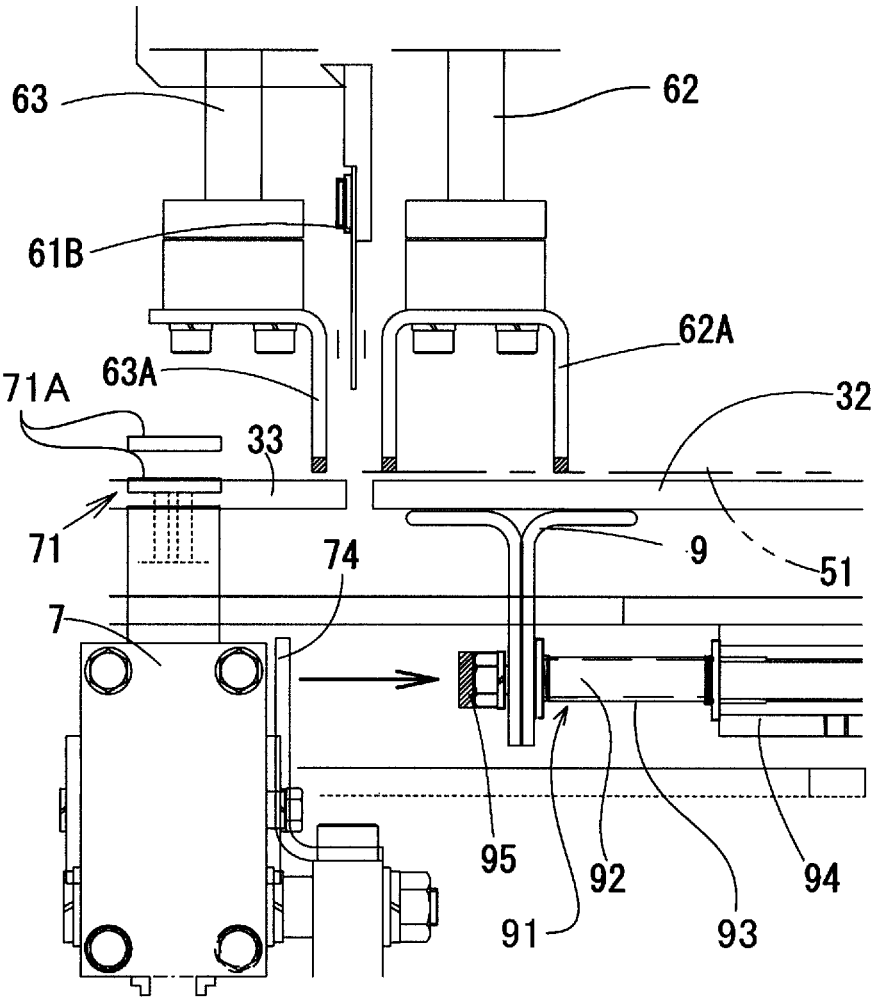
FIG. 12 illustrates a usage state of a slide mechanism of the apparatus.

The bag-supporting guide 9 is shaped like a letter T in front view. The lower portion of the T-shaped guide is attached to a damper shaft 92 of a damper mechanism 91 illustrated in FIGS. 8 to 10 and 12. The bag-supporting guide 9 is disposed so as to extend in the width direction under the intermediate table 32. Both ends of the bag-supporting guide 9 protrude from the intermediate table 32 in the width direction. The damper mechanism 91 is supported by a support portion 94 at the bottom of a member on each side of the opening 31A (see FIG. 7) of the main body 31. As illustrated in FIG. 12, a spring 93 is fit onto the damper shaft 92. The spring 93 always urges the bag-supporting guide 9 forward. A contact portion 74 between the damper mechanism 91 and the clip mechanism 7 reciprocates the bag-supporting guide 9 in the longitudinal direction. The action will be specifically described later.

(Actions)

The actions of the apparatus 1 for feeding bags will be described below.

As illustrated in FIG. 1, the film roll 5 is set on the shaft 45 of the reel mechanism 4 and the tube film 51 is drawn from the film roll 5 and is looped over the dancer rolls 41 and the guide rollers 43. The tube film 51 is then further drawn and is placed on the table 3 such that the front end of the tube film 51 lies on the clearance 34 of the table 3. Meanwhile, the front edge of the tube film 51 is pressed by the first pressing piece 62A of the press cutter 6. Thus, a preparation is completed. After the completion of the preparation, a start button for the rotary packaging machine 11 and the apparatus 1 for feeding bags is pressed to start an operation.

When the start button is pressed, the electric actuator 81 is started up and as illustrated in FIG. 8, the clip mechanisms 7 connected to the electric actuator 81 start moving rearward in order to hold the front end of the tube film 51.

Moreover, as illustrated in FIG. 9, the clip mechanisms 7 retract to the front end of the tube film 51 and stop thereon.

FIG. 12 illustrates a state before the contact portion 74 comes into contact with the damper shaft 92 of the damper mechanism 91. In FIG. 12, the bag-supporting guide 9 supports the tube film 51 so as to prevent both sides of the front end of the tube film 51 from bending downward. In the state of FIG. 12, the fingers 71A of the clip mechanism 7 are vertically opened by the actions of the open/close mechanism 72 and the hoisting and lowering mechanism 73 that are illustrated in FIG. 4.

Figure 13:
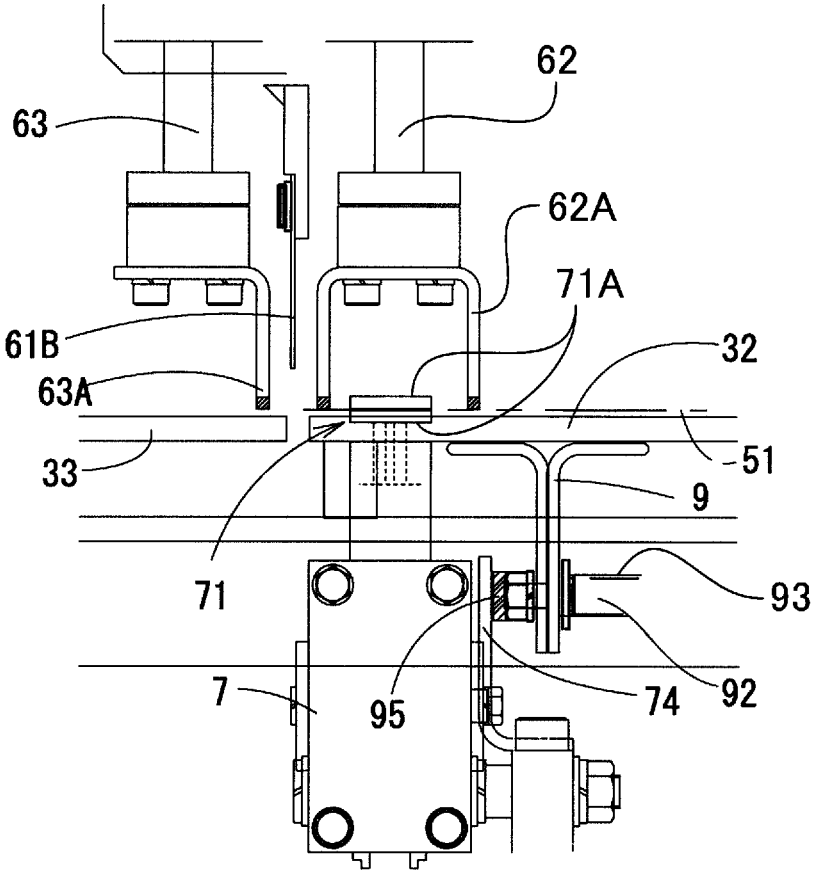
FIG. 13 illustrates another usage state of the slide mechanism.

FIG. 13 illustrates a state in which the clip mechanism 7 has retracted to the position of both sides of the front end of the tube film 51. In FIG. 13, the contact portion 74 comes into contact with a cushioning member 95 of the bag-supporting guide 9 and presses the damper shaft and the bag-supporting guide 9 rearward against the urging force of the spring 93. When the damper shaft 92 and the bag-supporting guide 9 are pressed to lift both sides of the front end of the film roll 5 supported by the bag-supporting guide 9, both sides of the front end of the tube film 51 are supported by the fingers 71A instead of the bag-supporting guide 9. At this point, the rail elevating cylinder 73A of the clip mechanism 7 illustrated in FIG. 4 is turned off and the fingers 71A are closed by the action of the spring 71B of the hoisting and lowering mechanism 73 and hold both sides of the front end of the tube film 51.

After the fingers 71A of the clip 71 hold the front end of the tube film 51, the electric actuator 81, which is specifically illustrated in FIGS. 4 and 5, is started to move the clip mechanism 7 forward. When the clip mechanism 7 is moved forward, as illustrated in FIG. 10, the tube film 51 is drawn forward. This stops the clip mechanism 7. FIG. 11A illustrates the state of the rear part of the drawn tube film 51.

After the tube film 51 is drawn forward and is stopped, as illustrated in FIG. 11B, the first pressing mechanism 62 and the second pressing mechanism 63 of the press cutter 6 press a position in front of the perforations 53 (not illustrated in FIG. 11B, see FIG. 6A) and a position behind the perforations 53 on the tube film 51. The first pressing piece 62A and the second pressing piece 63A may simultaneously press the tube film 51 or the second pressing piece 63A may press the tube film 51 after the pressing of the first pressing piece 62A.

Thereafter, as illustrated in FIG. 11C, the tube film 51 is cut with the cutting tool 61B along the perforations 53. Subsequently, the chuck 12A of the bag delivery device 12 in FIG. 1 holds the front end of the bag 51A cut from the tube film 51; meanwhile, the fingers 71A (see FIG. 4) of the clip 71 release the tube film 51. As illustrated in FIG. 1, the bag delivery device 12 then rotates to deliver the bag 51A to the clamp arm 11A of the rotary packaging machine 11. The subsequent steps are identical to those after the tube film 51 is set. Thus, the foregoing steps are repeated if a packaging operation by the rotary packaging machine 11 is continued.

The perforations 53 of the tube film 51 are not always positioned with accuracy at a portion where the bag 51A is cut off. Thus, the perforations 53 may be longitudinally displaced from a portion immediately under the cutting tool 61B. However, even if the perforations 53 are slightly displaced, the tube film 51 is typically cut at the portion of the perforations 53 because the portion has low strength. If the perforations 53 are displaced rearward from the portion immediately under the cutting tool 61B, the fingers 71A of the clip 71 hold the tube film 51 at a point outside a normal holding position. If the fingers 71A hold the bag 51A at a point outside the normal holding position, the clamp arm 11A of the rotary packaging machine 11 may fail to hold the bag 51A when the bag delivery device 12 delivers the bag 51A to the clamp arm 11A. Thus, a sensor (not illustrated) installed on the mounting plate 24B illustrated in FIG. 11A detects that the front end of the tube film 51 is located behind a predetermined position, the clip 71 (fingers 71A) temporarily releases the tube film 51, moves rearward according to the displacement, and then holds the tube film 51 again. Conversely, even if the bag 51A is held at a point inside the normal holding position, the clamp arm 11A does not fail to hold the bag 51A. In this case, the feeding operation of the bag 51A is continued. The sensor may be, for example, a fiber sensor or CCD camera.

Embodiment 2

Figure 14:
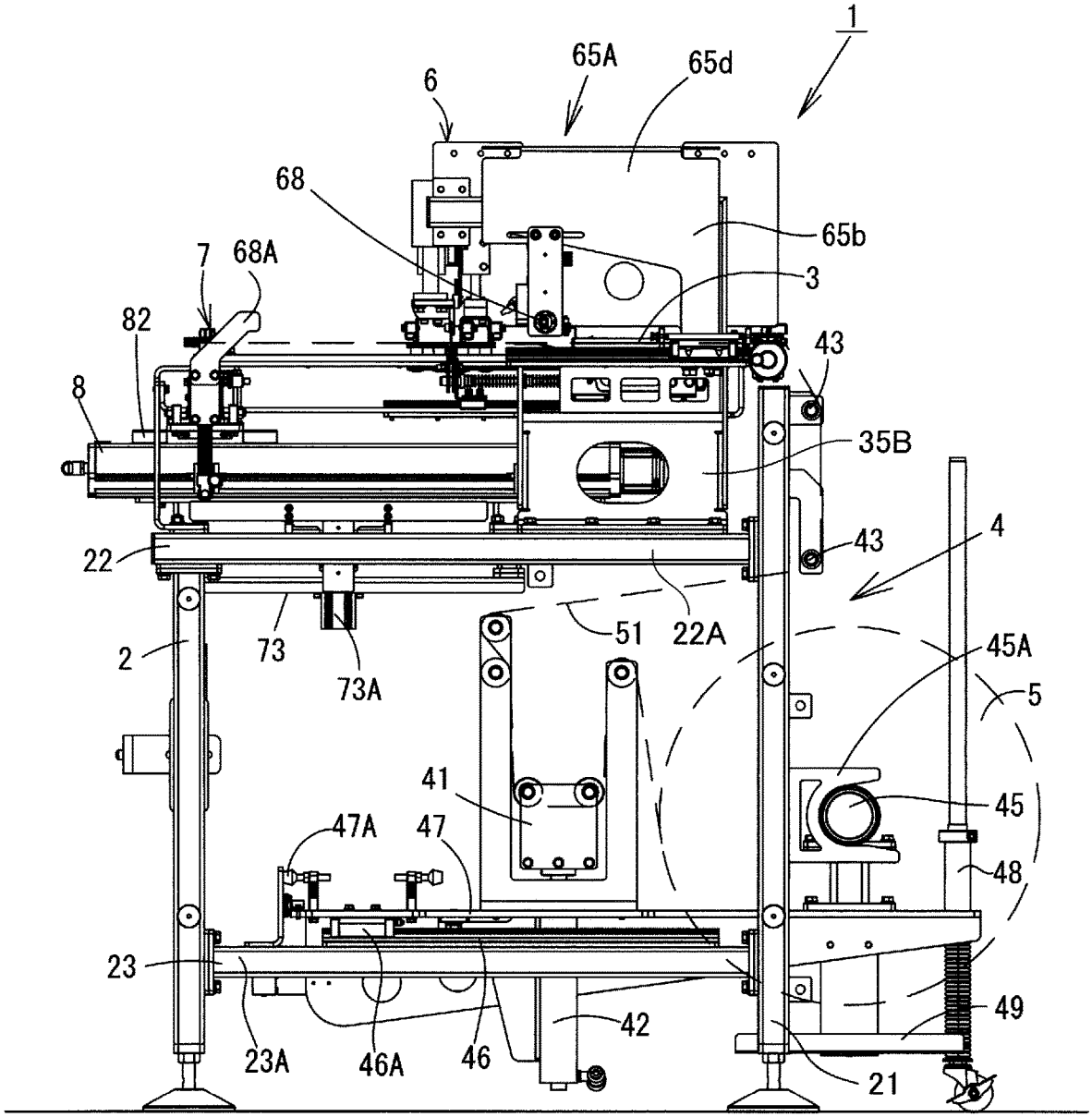
FIG. 14 is a front view illustrating an apparatus for feeding bags according to Embodiment 2 of the present invention.
Figure 15:
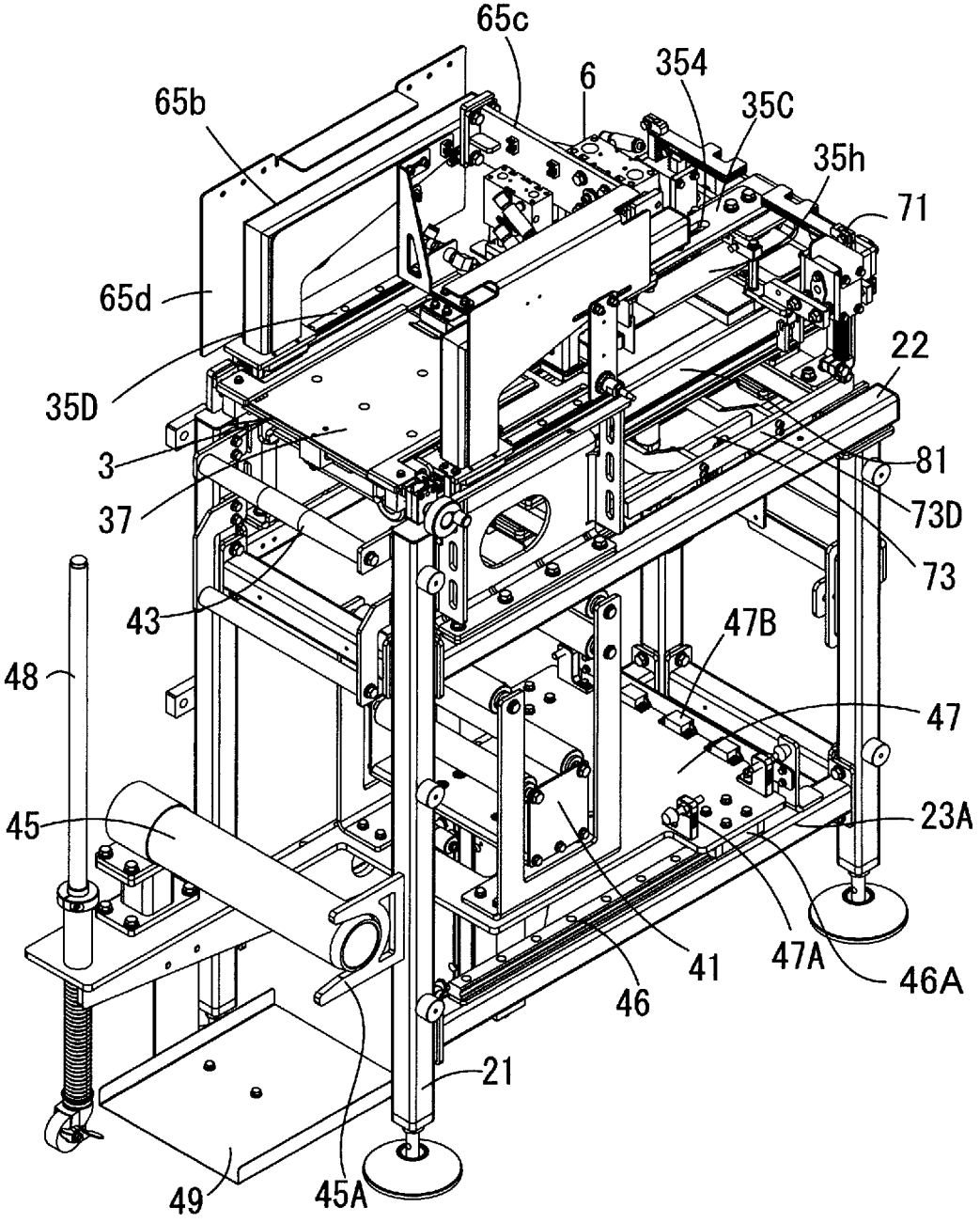
FIG. 15 is a three-dimensional view drawing illustrating the back side of the apparatus of FIG. 14.

Embodiment 2 of the present invention will be described below. FIG. 14 is a front view of an apparatus 1 for feeding bags according to Embodiment 2. FIG. 15 is a three-dimensional view of the apparatus. The basic configuration of Embodiment 2 is identical to that of Embodiment 1. Hence, differences from Embodiment 1 will be mainly described below. In the drawings, the same configurations and members are indicated by the same reference numerals. The apparatus 1 for feeding bags according to Embodiment 2 is an apparatus for feeding bags to a rotary packaging machine 11 and a linear or oval packaging machine.

(Reel Mechanism)

Figure 17:
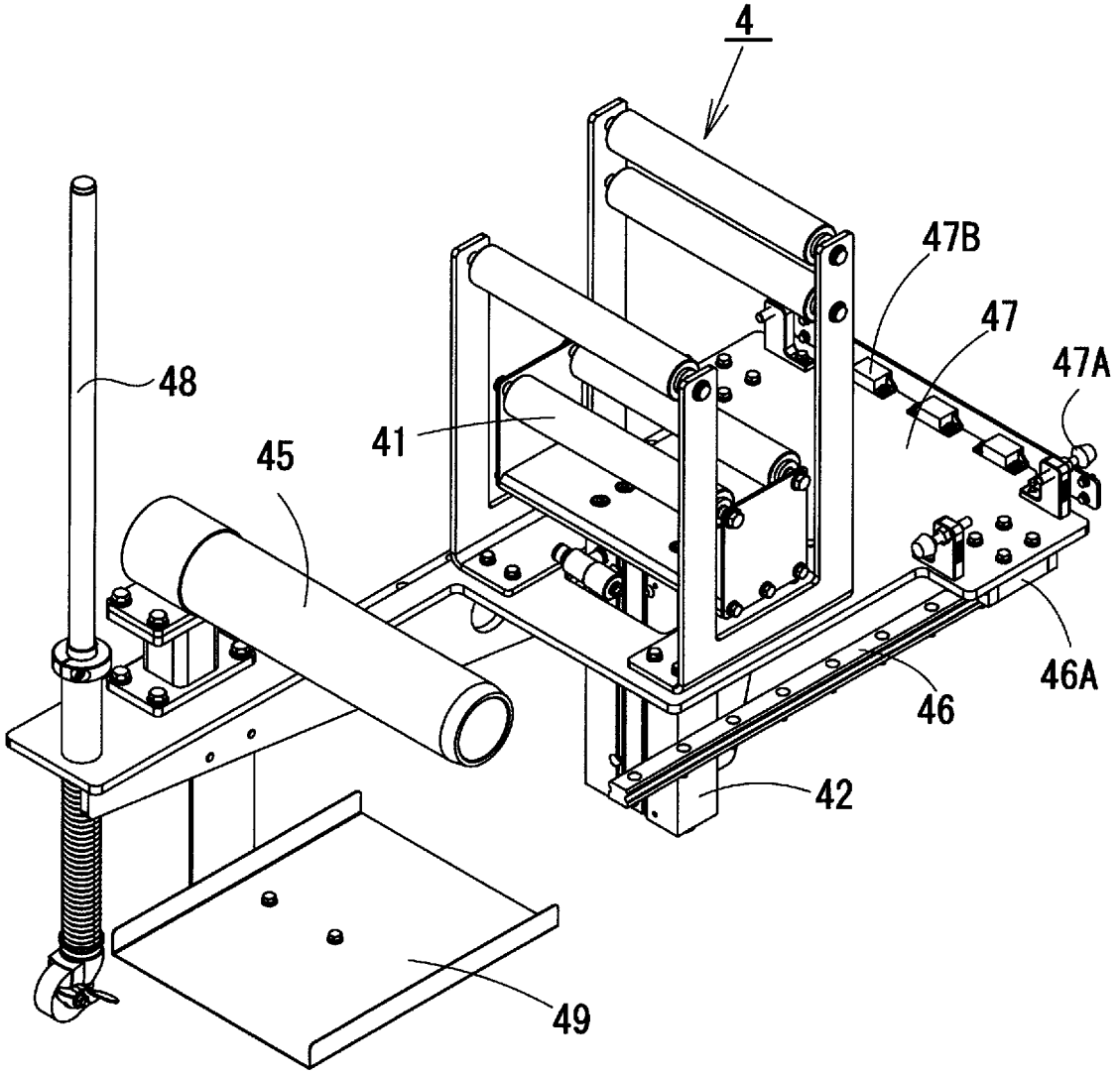
FIG. 17 is a three-dimensional view illustrating a reel mechanism in the apparatus of FIG. 14.

The apparatus 1 for feeding bags according to Embodiment 2 also includes a reel mechanism 4. In Embodiment 2, as illustrated in FIGS. 14, 15, and 17, a linear rail 46 is attached to a lower frame 23A on each side of the bottom of a frame 2. On the linear rails 46, a slide shelf 47 is placed so as to longitudinally slide with a slide block 46A interposed between the linear rail 46 and the slide shelf 47. In Embodiment 2, the reel mechanism 4 is disposed on the slide shelf 47. A dancer roll 41 of the reel mechanism 4 is provided at the center of the slide shelf 47. An air cylinder 42 is attached to the lower end of the dancer roll 41. The air cylinder 42 vertically drives the dancer roll 41. In Embodiment 2, guide rollers 43 at the upper parts of legs 21 are crown-type rolls, thereby suppressing meandering of a tube film 51.

At the rear of the slide shelf 47, a shaft 45 having a cantilever structure for setting a film roll 5 is horizontally mounted. The free end of the shaft 45 is supported by a C-shaped support member 45A attached to the leg 21. At the rear end of the slide shelf 47, a rod 48 with a caster is attached. The rod 48 with the caster moves the slide shelf 47 forward to store the reel mechanism 4 into the frame 2. The reel mechanism 4 stored in the frame 2 does not interfere with a packaging operation. The film roll 5 can be easily replaced by drawing the slide shelf 47.

A stopper 47A is provided at the front of the slide shelf 47. The stopper 47A regulates the moving range of the slide shelf 47. As illustrated in FIGS. 15 and 17, a plurality of magnets 47B are attached to the front edge of the slide shelf 47. The magnets 47B are attracted to the iron member of the frame 2, preventing the slide shelf 47 from protruding out of the frame 2. A contact-type sensor, which is not illustrated, is provided for the slide shelf 47 and the lower frame 23A. The sensor detects whether the reel mechanism 4 is properly stored in the frame. Reference numeral 49 denotes a guard. The guard 49 protects the film roll 5 from, for example, splashes of muddy water from the floor.

(Table)

Figure 16:
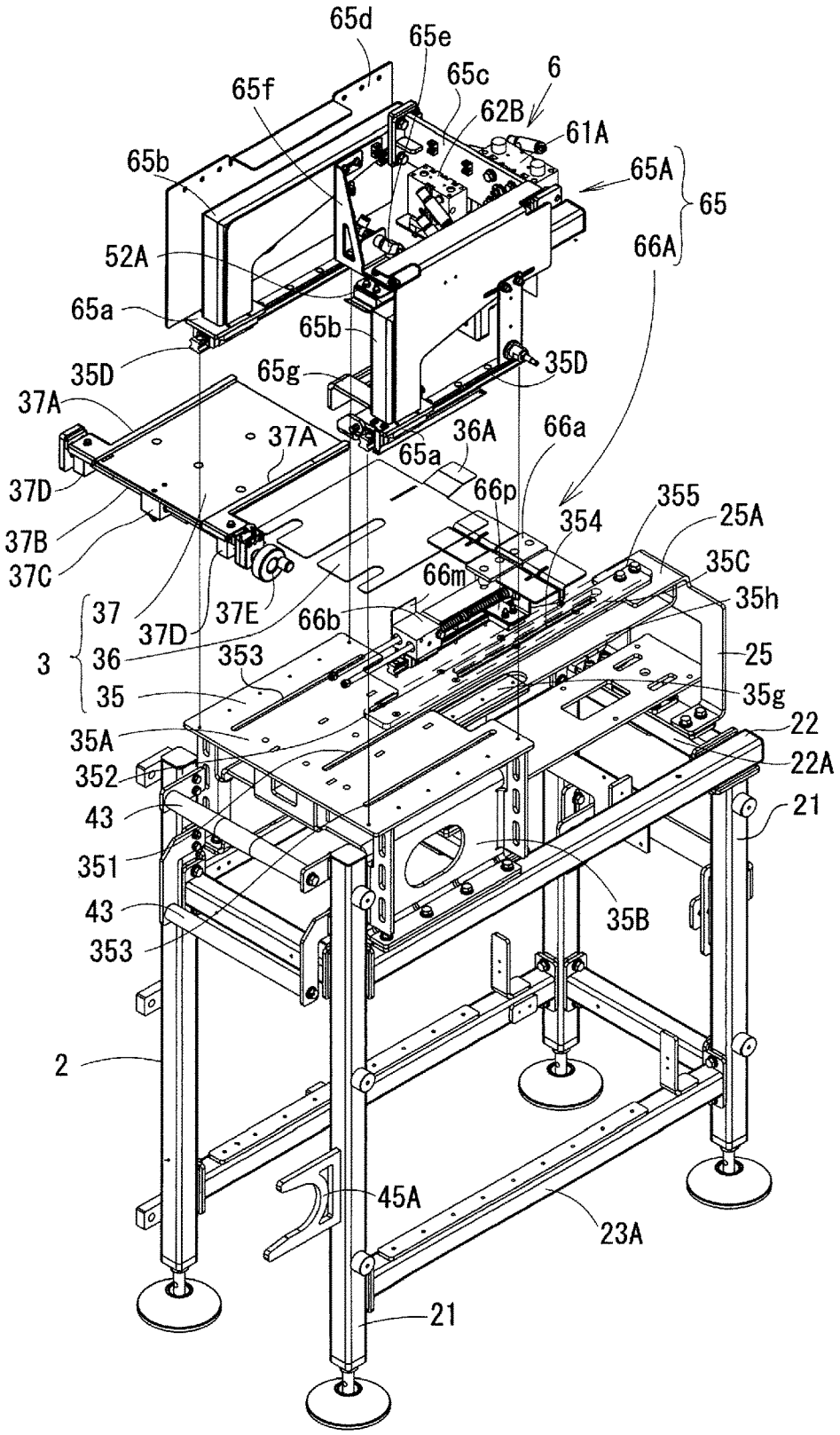
FIG. 16 is a three-dimensional view partially illustrating the apparatus of FIG. 14.

As illustrated in FIG. 16, a table 3 includes three plates disposed above an upper shelf 22 of the frame 2. Specifically, the table 3 includes a lower main table 35, a movable table 36 that can longitudinally slide on the main table 35, and an upper table 37 that is fixed to the rear part of the main table 35 without being brought into contact with the movable table 36. The table 3 guides the tube film 51 drawn from the film roll 5 illustrated in FIG. 14.

As illustrated in FIG. 16, the main table 35 has a unique shape and includes a substantially square substrate 35A and a rectangularly extended part 35C protruding forward from the center of the front edge of the substrate 35A. On the extended part 35C, a reinforcing plate 35*c* (see FIGS. 18, 20A, and 20B) is attached. The width of the substrate 35A is substantially equal to that of the frame 2 and the length of the substrate 35A is about one third that of the frame 2 in the longitudinal direction. The substrate 35A is fixed on a support member 35B provided at the rear part of an upper frame 22A of the upper shelf 22. The substrate 35A has a long slit 351 and a short slit 352 that are extended rearward from both sides of the rear part of the extended part 35C and have opened front ends. Furthermore, side slits 353 with closed ends are formed in the longitudinal direction on both sides of the substrate 35A. The functions of the slits 351, 352, and 353 will be described later.

The front end of the extended part 35C is fixed to the center of a gate plate 25 attached to the front of the upper frame 22A of the upper shelf 22 in the frame 2. The gate plate 25 includes a support piece 25A that is bent rearward at the center of the upper part of the gate plate 25. A front end 355 of the extended part 35C is fixed onto the support piece 25A. On the extended part 35C and the reinforcing plate 35*c*, a long slit 354 for sliding is formed. Into the slit 354 for sliding, a fixed portion 66*c* of a cutting base 66*a* for a press cutting unit 65, which will be described later, is mounted with lock pins 66*e* (see FIGS. 19, 20A, 20B, and 22).

Figure 18:
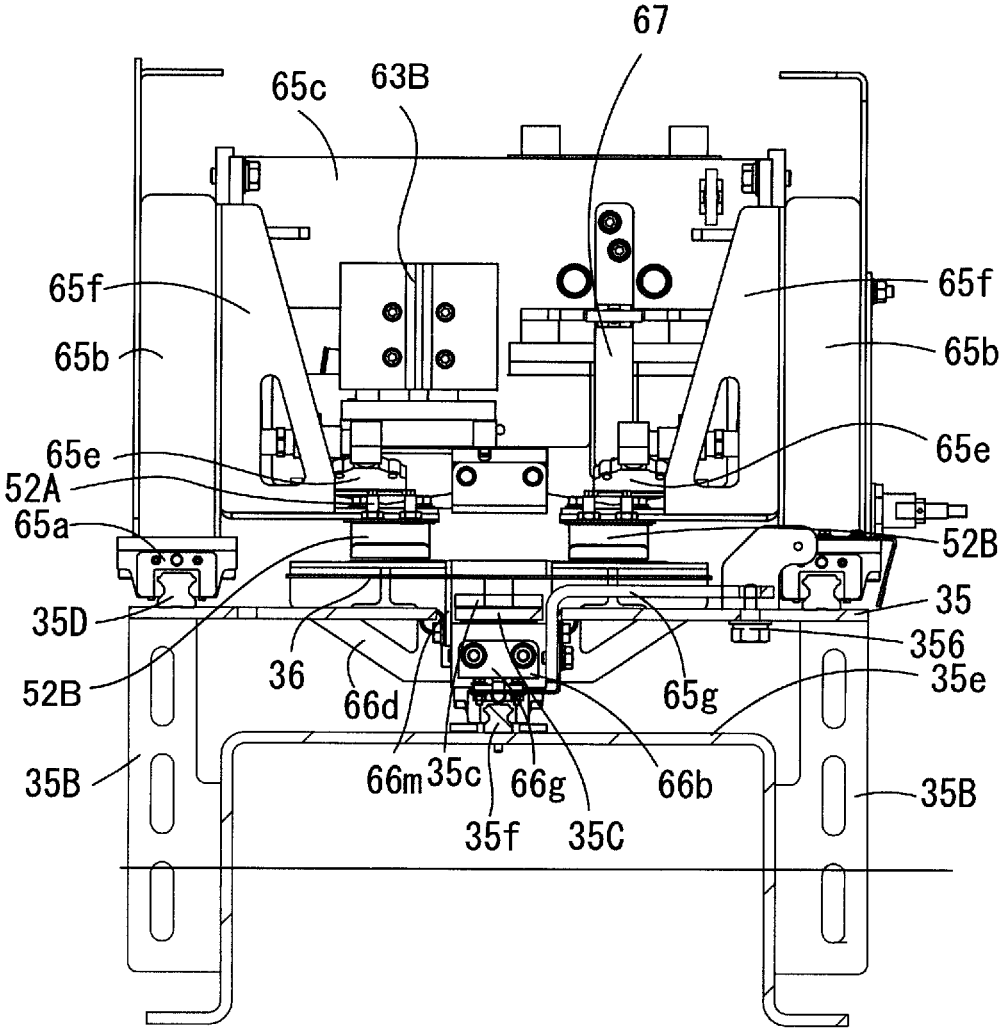
FIG. 18 is a partial three-dimensional view illustrating the apparatus of FIG. 14.
Figure 19:
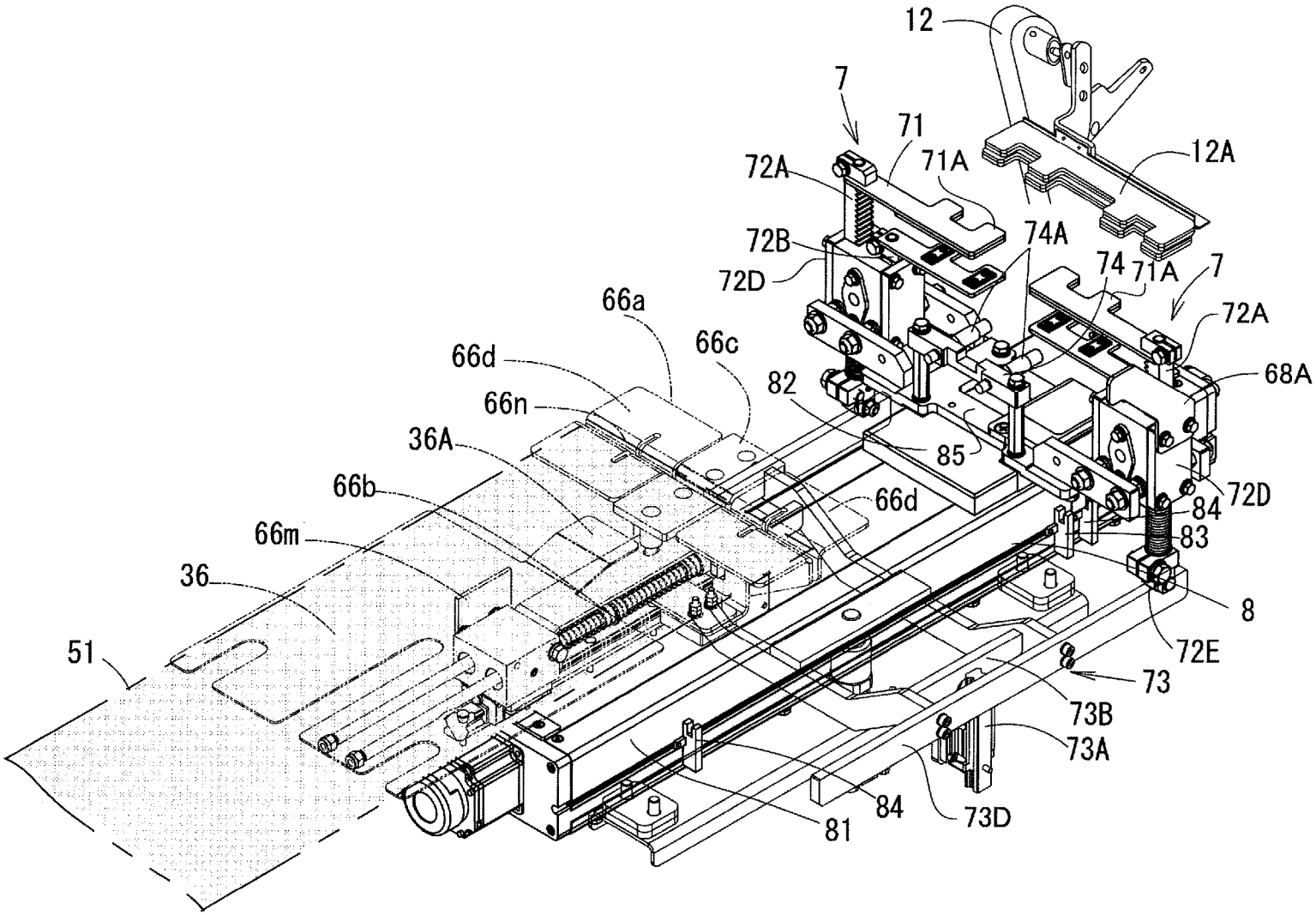
FIG. 19 is a partial single view drawing illustrating the apparatus of FIG. 14.

As illustrated in FIG. 16, the movable table 36 is substantially square and includes a projecting piece 36A that slightly bends upward at the center of the front end of the movable table 36. As illustrated in FIG. 19, the projecting piece 36A is not connected to the fixed portion 66*c* of the cutting base 66*a* and supports the tube film 51 between the movable table 36 and the cutting base 66*a*. As illustrated in FIGS. 18 and 19, a damper mechanism 66*b* is attached to the bottom of the movable table 36 with a connecting fitting 66*m*. As illustrated in FIGS. 16 and 19, a thick and long slit with the opened rear end is formed at the center of the movable table 36 and a short slit is formed on each side of the long slit. These slits are formed in order to prevent the movable table 36 from interfering with pins for fixing the upper table 37 when the movable table 36 is slid rearward at the time of a change of the dimensions of the bag 51A.

As illustrated in FIG. 16, the upper table 37 is substantially square. On each side of the upper table 37, a guide bar 37A for guiding the tube film 51 is longitudinally provided. The guide bars 37A can adjust a distance therebetween according to the width of the tube film 51. Specifically, a ball screw 37B is supported by a bearing 37C at the bottom of the rear end of the upper table 37, and a nut 37D is fit into each end of the ball screw 37B. A handle 37E is attached to one side of the ball screw 37B. The ball screw 37B is rotated using the handle 37E, so that the nut 37D on each side is moved in the reverse direction so as to change a distance between the guide bars 37A on both sides in the width direction.

(Press Cutting Unit)

Figure 22:
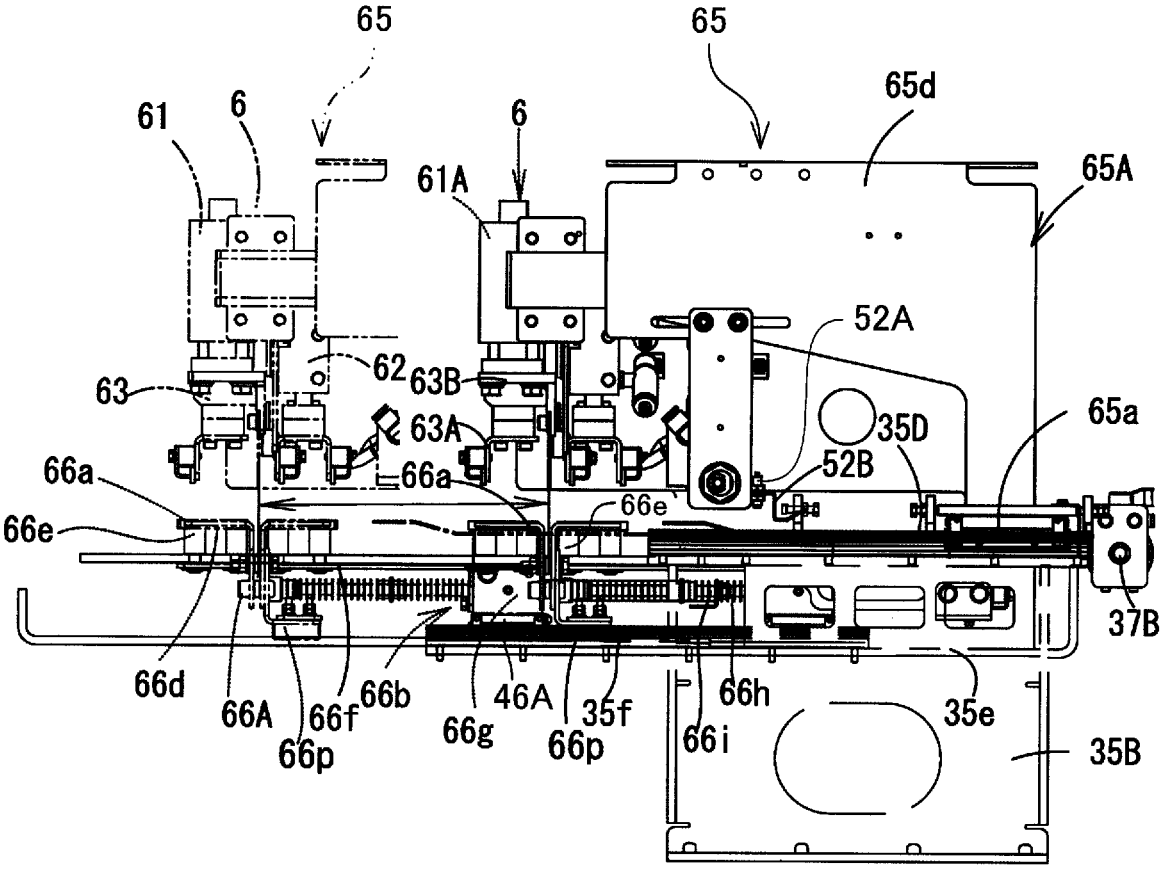
FIG. 22 is an explanatory view of the apparatus of FIG. 14.

Unlike in Embodiment 1, a press cutter 6 for cutting the tube film 51 in FIG. 16 is provided as a unit. The press cutting unit 65 includes a main unit 65A provided with the cutting mechanism 61 and the pressing mechanisms 62 and 63 that are illustrated in FIG. 22, and a sub unit 66A provided with the cutting base 66*a* on which the tube film 51 to be cut is placed (see FIGS. 22 and 16). The main unit 65A is provided on linear rails 35D attached to both sides of the substrate 35A of the main table 35 with a slide block 65*a* interposed between the main unit 65A and the linear rail 35D. Thus, when the size of the bag 51A is changed, the main unit 65A can be longitudinally slid and positioned according to the cutting position of the bag 51A. The sub unit 66A also slides with the sliding main unit 65A. FIG. 22 illustrates the press cutting unit 65 when the size of the bag 51A is changed. The press cutting unit 65 indicated by a solid line is positioned for the long bag 51A. The press cutting unit 65 indicated by a virtual line is positioned for the short bag 51A. The press cutter 6 and the cutting base 66*a* are moved in a range indicated by a horizontal arrow in FIG. 22, thereby changing the size of the bag 51A.

As illustrated in FIG. 16, the main unit 65A includes a pair of thick mounting arms 65*b*, each being shaped like a reversed letter L. The principal part of the main unit 65A is attached to a mounting plate 65*c* extended between the front ends of the pair of mounting arms 65*b*. The basic configuration of the press cutter 6 is substantially identical to that of the press cutter 6 according to Embodiment 1. Thus, the detailed explanation thereof is omitted. As has been discussed, the side slits 353 are formed on both sides of the substrate 35A. As illustrated in FIG. 18, a bolt 356 is inserted into the side slit 353 from below. The bolt 356 fixes the main unit 65A to the substrate 35A. When the size of the bag 51A is changed, the bolt 356 is loosened to longitudinally slide the main unit 65A along the side slits 353. Reference numeral 65*d* in FIGS. 14, 16, and 22 denotes protective covers. The protective covers are attached outside the mounting arms 65*b* as illustrated in FIG. 16. Protective covers are also provided at other appropriate points in order to secure the safety of an operator.

As illustrated in FIGS. 16 and 18, an air nozzle 65*e* is attached to the interior of the apparatus at the front parts of the mounting arms 65*b*. When the tube film 51 is cut by the cutting tool 61B (see FIGS. 20A and 20B) of the press cutter 6, a jet of air from the air nozzle 65*e* prevents the front end of the cut tube film 51 from being attracted to and lifted by the cutting tool 61B with static electricity or the like. If the front end of the tube film 51 is lifted, a clip mechanism 7 may fail to hold the tube film 51. Thus, the front end of the tube film 51 is pressed to the cutting base 66*a* by a jet of air from the air nozzle 65*e*.

As illustrated in FIG. 16, inside the mounting arms 65*b*, brackets 65*f* shaped like right triangles are provided behind the air nozzle 65*e*. Mark detecting sensors 52A are attached at the bottom of the brackets 65*f*. Like the mark detecting sensor 52A according to Embodiment 1, the mark detecting sensors 52A are provided to determine the feeding pitch of the tube film 51. In Embodiment 2, however, the mark detecting sensors 52A are provided on both sides of the apparatus, enabling detection on different kinds of film rolls 5. Moreover, at the rear parts of the mark detecting sensors 52A, film pressing pieces 52B as illustrated in FIGS. 18 and 22 are attached. The tube film 51 is pressed by the film pressing pieces 52B and thus does not become wavy on the table 3, eliminating erroneous detection.

Figure 20A:
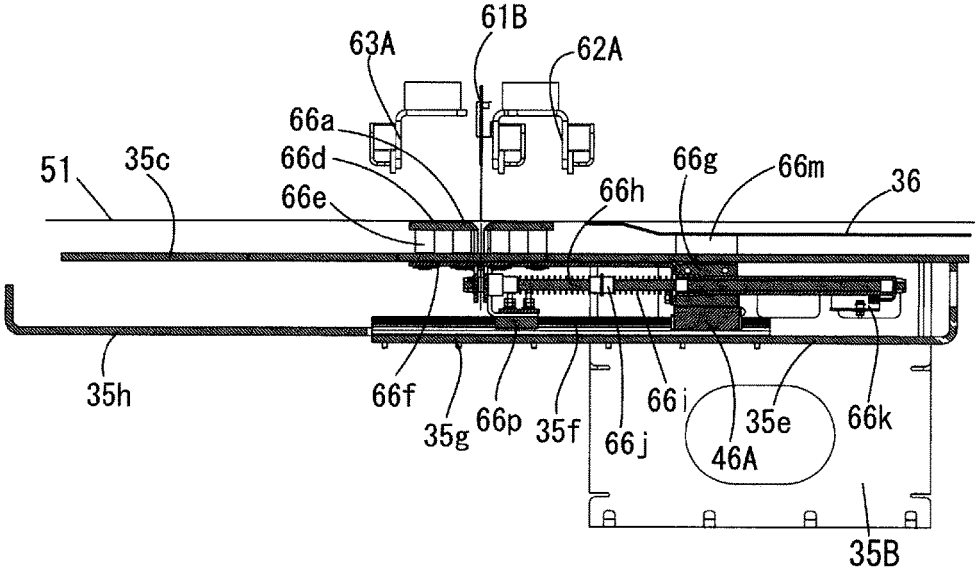
FIG. 20A is a view illustrating a usage state of the apparatus of FIG. 14.

As illustrated in FIG. 16, the sub unit 66A includes the cutting base 66*a* and the damper mechanism 66*b*. Moreover, the movable table 36 is attached to the sub unit 66A. As illustrated in FIG. 20A, the cutting base 66*a* supports the tube film 51 being delivered forward. When the tube film 51 is cut using the cutting tool 61B (see FIG. 20A) of the cutting mechanism 61 illustrated in FIG. 22, the cutting base 66*a* supports the end of the cut tube film 51 so as to prevent the end of the film from bending downward. If the front end of the tube film 51 bends downward after the tube film 51 is cut using the cutting tool 61B of the cutting mechanism 61, fingers 71A of the clip mechanism 7 may fail to hold the tube film 51.

As illustrated in FIG. 19, the cutting base 66*a* includes the central fixed portion 66*c* and movable portions 66*d* on both ends of the fixed portion 66*c*. As illustrated in FIGS. 19 and 22, the fixed portion 66*c* and the movable portions 66*d* are configured such that two plates shaped like reversed letters L are joined into a T-shape. As illustrated in FIG. 19, the fixed portion 66*c* and the movable portions 66*d* are provided with a clearance 66*n* disposed between plates shaped like reversed letters L, the clearance 66*n* being provided for inserting the cutting tool 61B of the cutting mechanism 61. As has been discussed, the upper ends of lock pins 66*e* are joined to the back side of the fixed portion 66*c*. The lower ends of the lock pins 66*e* are inserted into the slit 354 for sliding on the extended part 35C and the reinforcing plate 35*c* (see FIG. 18) and are fixed to a connecting plate 66*f* (see FIGS. 20B and 22). The connecting plate 66*f* is connected to a base 66*g* of the damper mechanism 66*b*. When the damper mechanism 66*b* is slid by the main unit 65A in order to change the size of the bag, the fixed portion 66*c* is also slid via the connecting plate 66*f* according to the same dimensions in the longitudinal direction.

Figure 20B:
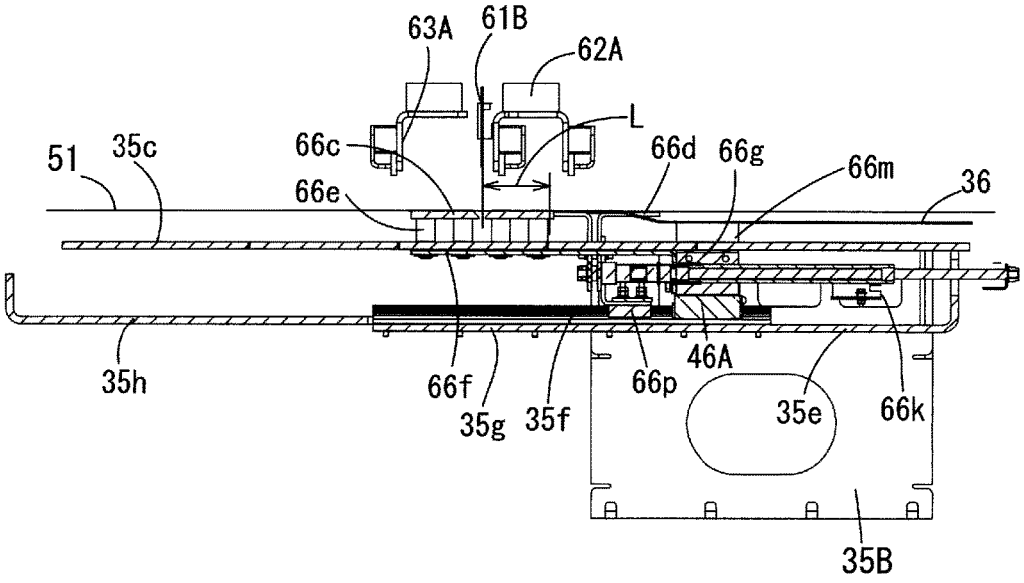
FIG. 20B is another view illustrating a usage state of the apparatus of FIG. 14.

The damper mechanism 66*b* connects the front ends of two dampers with the base 66*g*. As illustrated in FIG. 20A, the pair of movable portions 66*d* of the cutting base 66*a* are attached to the front end of a damper shaft 66*h*. Thus, when a contact portion 74 of the clip mechanism 7 illustrated in FIG. 19 comes into contact with the front end of the damper shaft 66*h* illustrated in FIG. 20A, the movable portions 66*d* retract backward. As illustrated in FIG. 20B, the movable portions 66*d* retract so as to lift the front end of the tube film 51, forming a holding margin L. The holding margin L is vertically held by the fingers 71A of the clip mechanism 7 illustrated in FIG. 19, and then the clip mechanism 7 draws the tube film 51 forward.

When the fingers 71A of the clip mechanism 7 draw the tube film 51 forward, the contact portion 74 of the clip mechanism 7 separates from the movable portions 66*d* accordingly. The movable portions 66*d* are moved to both sides of the fixed portion 66*c* as illustrated in FIG. 19 by springs 66*i* (see FIG. 20A) fit onto the damper shaft 66*h*. In this way, the cutting base 66*a* of Embodiment 2 acts like the bag-supporting guide 9 of Embodiment 1.

As illustrated in FIG. 20A, a sensor 66*k* is attached to the rear end of the damper shaft 66*h*. The sensor 66*k* detects whether the damper shaft 66*h* has been normally restored by the force of the springs 66*i*. If the springs 66*i* are weak and the damper shaft 66*h* has not been sufficiently restored, the cutting tool 61B of the press cutter 6 may be hit against the cutting base 66*a* and damaged. Since a long spring has a small urging force, the two short springs 66*i* are used and a coupling 66*j* is disposed between the springs, achieving higher spring strength.

As illustrated in FIG. 18, the damper mechanism 66*b* disposed under the main table 35 is not joined to the main table 35 but is joined to the movable table 36. In FIG. 16, the illustrated damper mechanism 66*b* is disposed on the main table 35. Specifically, as illustrated in FIG. 18, the base 66*g* of the damper mechanism 66*b* and the bottom of the movable table 36 are connected to each other via the single connecting fitting 66*m*. The connecting fitting 66*m* is not in contact with the extended part 35C and the reinforcing plate 35*c*. Thus, when the main unit 65A in FIG. 22 slides the damper mechanism 66*b*, the damper mechanism 66*b* and the movable table 36 in FIG. 18 slide together. When the size of the bag 51A is changed, the damper mechanism 66*b* sliding rearward may bring the connecting fitting 66*m* into contact with the substrate 35A (see FIG. 16) of the main table 35 and the press cutting unit 65 may not be sufficiently slid. In order to prevent this problem, as illustrated in FIG. 16, the short slit 352 with the opened front end is formed on the substrate 35A.

As illustrated in FIGS. 20A and 20B, the slide block 46A is attached under the base 66*g* of the damper mechanism 66*b*. The slide block 46A is placed on a linear rail 35*f* provided on an intermediate shelf 35*e* disposed below the main table 35. As illustrated in FIG. 22, the damper mechanism 66*b* slides on the linear rail 35*f* via the slide block 46A. At the center of the front edge of the intermediate shelf 35*e*, a rectangular protruding portion 35*g* is formed for placing the linear rail 35*f*. Moreover, a long support plate 35*h* is laid on the protruding portion 35*g*. As illustrated in FIG. 16, the front end of the support plate 35*h* is fixed to the center of the upper part of the gate plate 25. The support plate 35*h* supports a reinforcing slider 66*p* attached to one end of the damper shaft 66*h* and supports a force applied to the cutting base 66*a* when the tube film 51 is cut on the cutting base 66*a*. The force applied to the cutting base 66*a* may not be sufficiently supported by the protruding portion 35*g* alone but can be sufficiently supported by the protruding portion 35*g* and the support plate 35*h*.

In order to slide the main unit 65A and the sub unit 66A of the press cutting unit 65 together in the longitudinal direction, as illustrated in FIG. 18, the mounting arms 65*b* of the main unit 65A and the damper mechanism 66*b* are connected to each other via a connecting piece 65*g*. The connecting piece 65*g* is inserted into the long slit 351 (see FIG. 16) formed at the center of the main table 35 and is connected to the base 66*g* of the damper mechanism 66*b* on the undersurface of the main table 35. Thus, when the main unit 65A slides forward, the damper mechanism 66*b* also slides forward. The long slit 351 of the main table 35 is extended so as to allow a movement of the connecting piece 65*g*.

As illustrated in FIG. 18, a fiber sensor 67 is attached to the mounting plate 65*c*. As described in Embodiment 1, the fiber sensor 67 detects the position of the front end of the tube film 51 on the cutting base 66*a* after the tube film 51 is cut using the cutting tool 61B of the cutting mechanism 61. As described in Embodiment 1, if a position outside a predetermined position is detected, the clip 71 (fingers 71A) holds the tube film 51 again.

(Clip Mechanism and Slide Mechanism)

Figure 21:
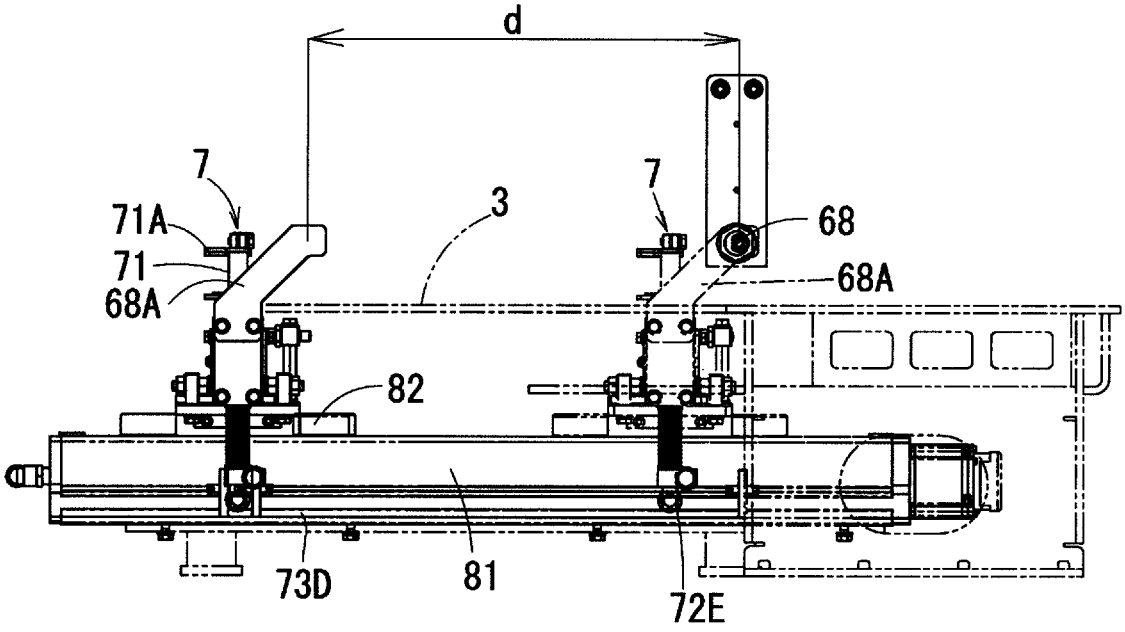
FIG. 21 is still another view illustrating a usage state of the apparatus of FIG. 14.

As illustrated in FIG. 19, the clip mechanism 7 is attached to a slide mechanism 8 and is longitudinally slid along the table 3 by the slide mechanism 8. This point is identical to that of Embodiment 1. However, the slide mechanism 8 does not have the slits 87 of Embodiment 1. On the electric actuator 81, a slider 82 with the clip mechanism 7 mounted thereon makes a reciprocating motion. This point is different from Embodiment 1. An origin sensor 68 (see FIGS. 14 and 21) for detecting the position of the origin of the slide mechanism 8 is attached to the mounting arms 65*b* (see FIG. 14). The origin sensor 68 detects a detected plate 68A (see FIG. 21) attached to one side of the slide mechanism 8. FIG. 21 indicates a distance d for sliding the clip mechanism 7. The distance d is determined by the size of the bag 51A. Specifically, the clip mechanism 7 at the front is always located at the same position but the clip mechanism 7 slid rearward is located according to the size of the bag. The mounting position of the origin sensor 68 is similarly changed. The configuration of a hoisting and lowering mechanism 73 (see FIGS. 14 and 19) for hoisting and lowering the clip mechanism 7 is substantially identical to that of Embodiment 1. Thus, the configuration is indicated by the same reference numerals and the detailed explanation thereof is omitted.

As illustrated in FIG. 19, a mounting plate 85 for mounting the clip mechanism 7 is fixed to the slider 82 across the upper part of the electric actuator 81. On each end of the mounting plate 85, a gear box 72D including racks 72A and 72B and a pinion (not illustrated) is fixed. The contact portion 74 is attached to the center of the rear part of the mounting plate 85. The contact portion 74 is shaped like a gate. The contact portion 74 has two shock absorbers 74A attached thereon in the longitudinal direction. The shock absorbers 74A suppress impulsive sound when the contact portion 74 hits against the movable portions 66*d* of the damper mechanism 66*b*. The configuration of the clip mechanism 7 is substantially identical to that of Embodiment 1. Embodiment 2 is different from Embodiment 1 in that the fingers 71A are shaped like letters F as illustrated in FIG. 19. The configurations of the fingers 71A allow a chuck 12A (see FIG. 1) of a bag delivery device 12 to securely hold the end of the tube film 51. Also in Embodiment 2, non-slip members are attached to the inner surfaces of the fingers 71A.

Another Embodiment

In Embodiments 1 and 2, the fingers 71A of the clip mechanism 7 are opened and closed by lifting and lowering the elevating rail 73D. In the present invention, the configuration for opening and closing the fingers 71A is not particularly limited. For example, the fingers 71A may be directly opened and closed by an actuator (not illustrated). Furthermore, the slide mechanism 8 is not limited to the electric actuator 81. A combination of a motor and ball screws or the like may be used instead.

An apparatus for feeding bags according to the present invention is applicable to an apparatus for feeding bags so as to successively feed packaging bags to a packaging machine, e.g., a rotary packaging machine.

What is claimed is:

1. An apparatus for feeding bags, comprising:

a reel mechanism supporting a film roll on which a tube film is wound, the reel mechanism feeding the tube film forward;

a table for guiding the tube film fed from the reel mechanism;

a clip mechanism including a clip for holding the tube film on the table, the clip mechanism drawing the tube film held by the clip to a front end of the table;

a press cutter for cutting the tube film into a predetermined length while pressing the tube film drawn by the clip mechanism; and a drive mechanism for longitudinally reciprocating the clip mechanism.

2. The apparatus for feeding bags according to claim 1, wherein the clip of the clip mechanism includes a pair of fingers for holding the tube film, and the clip mechanism includes an open/close mechanism for opening and closing the pair of fingers.

3. The apparatus for feeding bags according to claim 2, wherein the open/close mechanism of the clip mechanism includes:

a pair of racks attached to the respective fingers;

a pinion engaged with the racks;

a rod with one end connected to one of the racks;

a wheel provided on the other end of the rod; and a driving rail in contact with an outer surface of the wheel, the driving rail reciprocating in a longitudinal direction of the rod so as to move the pair of racks in opposite directions and open or close the pair of fingers in the clip mechanism.

4. The apparatus for feeding bags according to claim 2, wherein the fingers of the clip mechanism each include a projecting piece that projects forward and supports a front end of the tube film.

5. The apparatus for feeding bags according to claim 1, wherein the table includes a main body, an intermediate table, and a front-end table, the intermediate table and front-end table being smaller in width than the tube film, the apparatus for feeding bags includes:

a clearance provided between the intermediate table and the front-end table such that a cutting tool of the press cutter is inserted into the clearance;

a bag-supporting guide that is wider than the intermediate table and is so wide as to support a front end of the tube film; and a damper mechanism supporting the bag-supporting guide, the main body and the intermediate table are extendable relative to each other and the intermediate table and the front-end table are extendable relative to each other, and the bag-supporting guide is longitudinally reciprocated on a front end of the intermediate table by the clip mechanism and the damper mechanism.

6. The apparatus for feeding bags according to claim 1, wherein the press cutter includes:

a cutting tool for cutting the tube film;

a first pressing mechanism for pressing the tube film at a position behind the cutting tool; and a second pressing mechanism for pressing the tube film at a position in front of the cutting tool.

7. The apparatus for feeding bags according to claim 1, wherein the press cutter comprises a press cutting unit including a main unit and a sub unit, the main unit comprises a cutting mechanism and a pressing mechanism, the sub unit comprises a cutting base on which the tube film to be cut is placed, and the main unit and the sub unit are connected to each other so as to move together according to a change of a size of the bag.

8. The apparatus for feeding bags according to claim 1, further comprising:

a cutting base for supporting the tube film when the tube film is cut using the cutter, wherein the cutting base includes a fixed portion and a movable portion, the fixed portion and the movable portion are provided with a clearance in a width direction such that a cutting tool of the cutter is inserted into the clearance, and the apparatus for feeding bags includes a damper mechanism for longitudinally projecting and retracting the movable portion attached to the damper mechanism, the movable portion being retracted so as to form a holding margin on an end of the tube film, the holding margin being formed for clipping by the clip mechanism.

9. The apparatus for feeding bags according to claim 1, further comprising:

a frame;

a linear rail attached to a bottom of the frame; and a slide shelf movable along the linear rail, wherein the reel mechanism is disposed on the slide shelf.

* * * * *